United States Patent [19]

Shirai et al.

[11] Patent Number: 4,780,387

[45] Date of Patent: Oct. 25, 1988

[54] LIGHT RECEIVING MEMBER FOR USE IN ELECTROPHOTOGRAPHY COMPRISING AMORPHOUS SILICON LAYER AND POLYCRYSTALLINE LAYER

[75] Inventors: Shigeru Shirai, Shiga; Keishi Saitoh, Nagahama; Takayoshi Arai, Nagahami; Minoru Kato, Nagahama; Yasushi Fujioka, Nagahama, all of Japan

[73] Assignee: Canon Kabushiki Kaisha, Tokyo, Japan

[21] Appl. No.: 16,777

[22] Filed: Feb. 20, 1987

[30] Foreign Application Priority Data

Feb. 22, 1986 [JP] Japan ..... 61-37570

[51] Int. Cl.[4] ..... G03G 5/82

[52] U.S. Cl. ..... 430/60; 430/66; 430/84

[58] Field of Search ..... 430/60, 63, 66, 84

[56] References Cited

U.S. PATENT DOCUMENTS 4,403,026 9/1983 Shimtzu et al. ..... 430/66

4,666,808 5/1977 Kawamura et al. ..... 430/66

*Primary Examiner*—J. David Welsh

*Attorney, Agent, or Firm*—Fitzpatrick, Cella, Harper & Scinto

[57] ABSTRACT

There is provided an improved light receiving member for use in electrophotography comprising a substrate for electrophotography and a light receiving layer constituted by a contact layer formed of a polycrystal material containing silicon atoms as the main constituent atoms and at least one kind selected from nitrogen atoms, oxygen atoms and carbon atoms, a photoconductive layer formed of an amorphous material containing silicon atoms as the main constituent atoms and a surface layer formed of an amorphous material containing silicon atoms, carbon atoms and hydrogen atoms, the amount of the hydrogen atoms contained in the surface layer being in the range from $1\times10^{-3}$ to 40 atomic %. The light receiving layer may have a charge injection inhibition layer or/and an absorption layer of light having a long wavelength.

34 Claims, 9 Drawing Sheets

LIGHT RECEIVING MEMBER FOR USE IN ELECTROPHOTOGRAPHY COMPRISING AMORPHOUS SILICON LAYER AND POLYCRYSTALLINE LAYER

FIELD OF THE INVENTION

This invention relates to an improved light receiving member for use in electrophotography which is sensitive to electromagnetic waves such as light (which herein means in a broader sense those lights such as ultra-violet rays, visible rays, infrared rays, X-rays and γ-rays).

BACKGROUND OF THE INVENTION

For the photoconductive material to constitute a light receiving layer in a light receiving member for use in electrophotography, it is required to be highly sensitive, to have a high SN ratio [photocurrent (Ip)/dark current (Id)], to have absorption spectrum characteristics suited for the spectrum characteristics of an electromagnetic wave to be irradiated, to be quickly responsive and to have a desired dark resistance. It is also required to be not harmful to living things as well as man upon the use.

Especially, in the case where it is the light receiving member to be applied in an electrophotographic machine for use in office, causing no pollution is indeed important.

From these standpoints, the public attention has been focused on light receiving members comprising amorphous materials containing silicon atoms (hereinafter referred to as "a-Si"), for example, as disclosed in Offenlegungsschriftes Nos. 2746967 and 2855718 which disclose use of the light receiving member as an image-forming member in electrophotography.

For the conventional light receiving members comprising a-Si materials, there have been made improvements in their optical, electric and photoconductive characteristics such as dark resistance, photosensitivity, and photoresponsiveness, use-environmental characteristics, economic stability and durability.

However, there are still left subjects to make further improvements in their characteristics in the synthesis situation in order to make such light receiving member practically usable.

For example, in the case where such conventional light receiving member is employed in the light receiving member for use in electrophotography with aiming at heightening the photosensitivity and dark resistance, there are often observed a residual voltage on the conventional light receiving member upon use, and when it is repeatedly used for a long period of time, fatigues due to the repeated use will be accumulated to cause the so-called ghost phenomena inviting residual images.

Further, in the preparation of the light receiving layer of the conventional light receiving member for use in electrophotography using an a-Si material, hydrogen atoms, halogen atoms such as fluorine atoms or chlorine atoms, elements for controlling the electrical conduction type such as boron atoms or phosphorus atoms, or other kinds of atoms for improving the characteristics are selectively incorporated in the light receiving layer.

However, the resulting light receiving layer sometimes is accompanied with defects on the electrical characteristics, photoconductive characteristics and/or breakdown voltage according to the way of the incorporation of said constituents to be employed.

That is, in the case of using the light receiving member having such light receiving layer, the life of a photocarrier generated in the layer with the irradiation of light is not sufficient, the inhibition of a charge injection from the side of the substrate in a dark layer region is not sufficiently carried out, and image defects likely due to a local breakdown phenomenon which is so-called "white oval marks on half-tone copies" or other image defects likely due to abrasion upon using a blade for the cleaning which is so-called "white line" are apt to appear on the transferred images on a paper sheet.

Further, in the case where the above light receiving member is used in a much moist atmosphere, or in the case where after being placed in that atmosphere it is used, the so-called "image flow" sometimes appears on the transferred images on a paper sheet.

In consequence, it is necessitated not only to make a further improvement in an a-Si material itself but also to establish such a light receiving member not to invite any of the foregoing problems.

SUMMARY OF THE INVENTION

The object of this invention is to provide a light receiving member for use in electrophotography which has a light receiving layer free from the foregoing problems and capable of satisfying various kind of requirements in electrophotography.

That is, the main object of this invention is to provide a light receiving member for use in electrophototography which has a light receiving layer comprising a layer formed of a-Si and a layer formed of a polycrystal material containing silicon atoms (hereinafter referred to as "poly-Si"), that electrical, optical and photoconductive properties are always substantially stable scarcely depending on the working circumstances, and that is excellent against optical fatigue, causes no degradation upon repeating use, excellent in durability and moisture-proofness and exhibits no or scarce residual voltage.

Another object of this invention is to provide a light receiving member for use in electrophotography which has a light receiving layer comprising a layer formed of a-Si and a layer formed of poly-Si, which is excellent in the close bondability with a substrate on which the layer is disposed or between the laminated layers, dense and stable in view of the structural arrangement and is of high quality.

A further object of this invention is to provide a light receiving member for use in electrophotography which has a light receiving layer comprising a layer formed of a-Si and a layer formed of poly-Si, which exhibits a sufficient charge-maintaining function in the electrification process of forming electrostatic latent images and excellent electrophotographic characteristics when it is used in electrophotographic method.

A still further object of this invention is to provide a light receiving member for use in electrophotography which has a light receiving layer comprising a layer formed of a-Si and a layer formed of poly-Si, which invites neither an image defect nor an image flow on the resulting visible images on a paper sheet upon repeated use in a long period of time and which gives highly resolved visible images with clearer half-tone which are highly dense and quality.

Other object of this invention is to provide a light receiving member for use in electrophotography which has a light receiving layer comprising a layer formed of a-Si and a layer formed of poly-Si, which has a high photosensitivity, high S/N ratio and high electrical voltage withstanding property.

In order to overcome the foregoing problems on the conventional light receiving member for use in electrophotography and attaining the above-mentioned objects, the present inventors have made various studies while focusing on its surface layer and other constituent layer. As a result, the present inventors have found that when the surface layer is formed of an amorphous material containing silicon atoms, carbon atoms and hydrogen atoms and the content of the hydrogen atoms is controlled to be in the range between $1\times10^{-3}$ and 40 atomic %, and that when a contact layer formed of a polycrystal material containing silicon atoms and at least one kind selected from nitrogen atoms, oxygen atoms and carbon atoms is disposed on the substrate, those problems on the conventional light receiving member for use in electrophotography can be satisfactorily eliminated and the above-mentioned objects can be effectively attained.

Accordingly, this invention is to provide a light receiving member for use in electrophotography basically comprising a substrate usable for electrophotography, a light receiving layer comprising a contact layer formed of a polycrystal material containing silicon atoms as the main constituent atoms and at least one kind selected from nitrogen atoms, oxygen atoms and carbon atoms, a photoconductive layer formed of an amorphous material containing silicon atoms as the main constituent atoms and at least one kind selected from hydrogen atoms and halogen atoms hereinafter referred to as "A-Si(H,X)"], and a surface layer having a free surface being formed of an amorphous material containing silicon atoms, carbon atoms and hydrogen atoms (hereinafter referred to as "A-Si:C:H") in which the amount of the hydrogen atoms to be contained is ranging from $1\times10^{-3}$ to 40 atomic %.

It is possible for the light receiving member according to this invention to have a charge injection inhibition layer, which is formed of an amorphous material or a polycrystal material containing silicon atoms as the main constituent atoms and an element for controlling the conductivity, between the contact layer and the photoconductive layer.

It is also possible for the light receiving member according to this invention to have an absorption layer for light of long wavelength (hereinafter referred to as "IR layer"), which is formed of an amorphous material containing silicon atoms and germanium atoms, and if necessary, at least either hydrogen atoms or halogen atoms [hereinafter referred to as "A-SiGe(H,Z)"], between the substrate and the charge injection inhibition layer.

And the above-mentioned photoconductive layer may contain one or more kinds selected from oxygen atoms, nitrogen atoms, and an element for controlling the conductivity as the layer constituent atoms.

The above-mentioned charge injection inhibition layer may contain hydrogen atoms and/or halogen atoms, and, further, in case where necessary, at least one kind selected from nitrogen atoms, oxygen atoms and carbon atoms as the layer constituent atoms.

The above-mentioned IR layer may contain one or more kinds selected from nitrogen atoms, oxygen atoms, carbon atoms, and an element for controlling the conductivity as the layer constituent atoms.

The light receiving member having the above-mentioned light receiving layer for use in electrophotography according to this invention is free from the foregoing problems on the conventional light receiving members for use in electrophotography, has a wealth of practically applicable excellent electric, optical and phtoconductive characteristics and is accompanied with an excellent durability and satisfactory use environmental characteristics.

Particularly, the light receiving member for use in electrophotography according to this invention has substantially stable electric characteristics without depending on the working circumstances, maintains a high photosensitivity and a high S/N ratio and does not invite any undesirable influence due to residual voltage even when it is repeatedly used for along period of time. In addition, it has sufficient moisture registant and optical fatigue resistance, and cause neither degradation upon repeating use nor any defect on breakdown voltage.

Because of this, according to the light receiving member for use in electrophotography of this invention, even upon repeated use for a long period of time, highly resolved visible images with clearer half tone which are highly dense and quality are stably obtained.

BRIEF DESCRIPTION OF THE DRAWINGS

FIG. 2 (A) through FIG. 2 (C) are schematic views for examples of the shape at the surface of the substrate in the light receiving member for use in electrophotography according to this invention;

FIG. 3 is a schematic view for a preferred example of the light receiving member for use in electrophotography according to this invention which has a light receiving layer as shown in FIG. 1-1 formed on the substrate having a preferred surface;

DETAILED DESCRIPTION OF THE INVENTION

Figure 1:
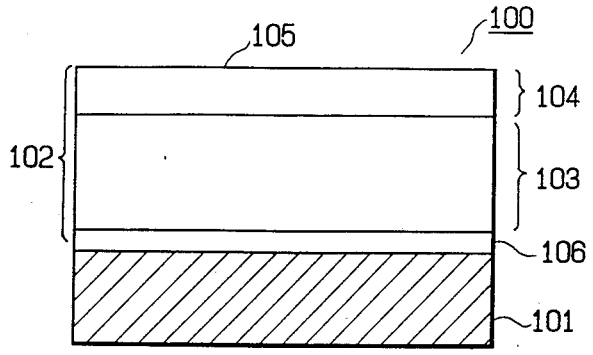
FIG. 1-1 through FIG. 1-3 are schematic views illustrating the typical layer constitution of a representative light receiving member for use in electrophotography according to this invention.

Representative embodiments of the light receiving member for use in electrophotography according to this invention will now be explained more specifically referring to the drawings. The description is not intended to limit the scope of this invention.

Figures 1, 2:
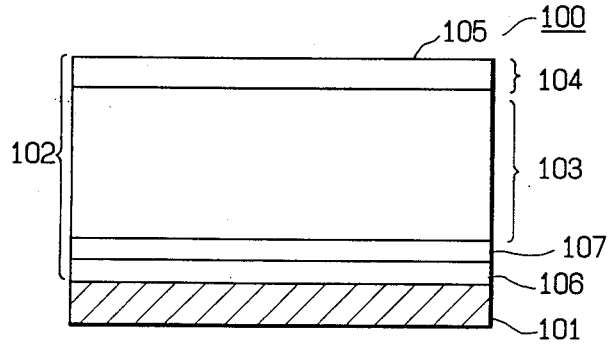
Figures 1, 2, 3:
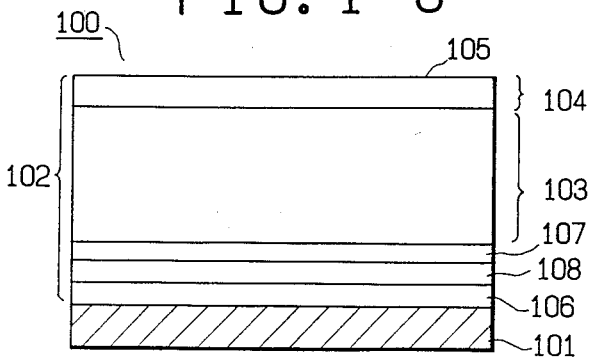
Figure 2:
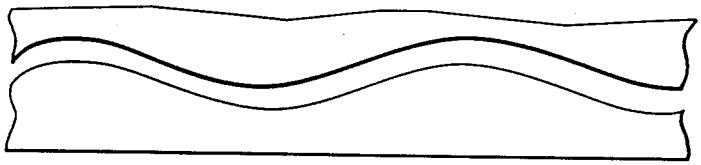
Figure 2:
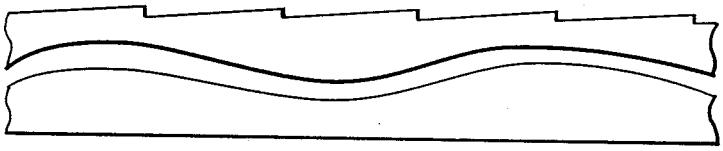
Figure 2:
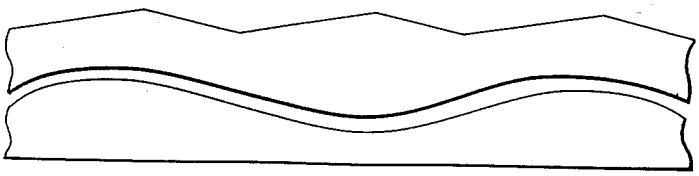
Figure 3:
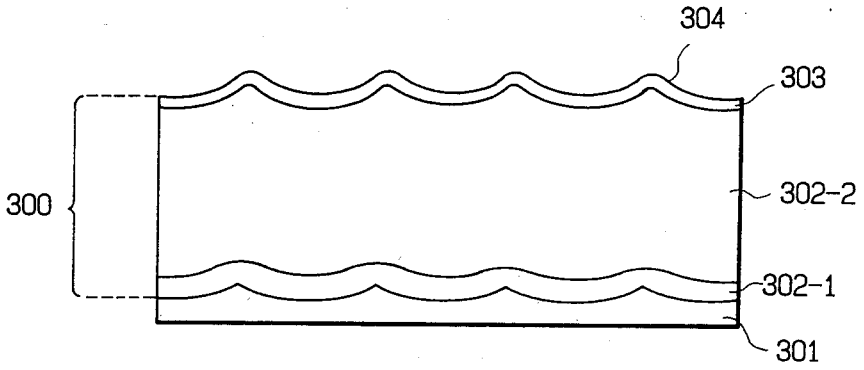

Representative light receiving members for use in electrophotography according to this invention are as shown in FIG. 1-1 through FIG. 1-3, in which are shown light receiving member 100, substrate 101, light receiving layer 102, photoconductive layer 103, surface layer 104, free surface 105, contact layer 106, charge injection inhibition layer 107, and IR layer 108.

FIG. 1-1 is a schematic view illustrating a typical representative layer constitution of this invention, in which is shown the light receiving member 100 comprising the substrate 101 and the light receiving layer 102 constituted by the contact layer 106, the photoconductive layer 103 and the surface layer 104.

FIG. 1-2 is a schematic view illustrating another representative layer constitution of this invention, in which is shown the light receiving member 100 comprising the substrate 101 and the light receiving layer 102 constituted by the contact layer 106, the charge injection inhibition layer 107, the photoconductive layer 103 and the surface layer 104.

FIG. 1-3 is a schematic view illustrating another representative layer constitution of this invention, in which is shown the light receiving member 100 comprising the substrate 101 and the light receiving layer 102 constituted by the contact layer 106, the IR layer 108, the charge injection inhibition layer 107, the photoconductive layer 103 and the surface layer 104.

Now, explanation will be made for the substrate and each constituent layer in the light receiving member of this invention.

Substrate 101

The substrate 101 for use in this invention may either be electroconductive or insulative. The electroconductive support can include, for example, metals such as NiCr, stainless steels, Al, Cr, Mo, Au, Nb, Ta, V, Ti, Pt and Pb or the alloys thereof.

The electrically insulative support can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses. For instance, in the case of using the light receiving member shown in FIG. 1 in continuous high speed reproduction, it is desirably configurated into an endless belt or cylindrical form.

The thickness of the support member is properly determined so that the light receiving member as desired can be formed.

In the case where flexibility is required for the light receiving member, it can be made as thin as possible within a range capable of sufficiently providing the function as the substrate. However, the thickness is usually greater than 10 μm in view of the fabrication and handling or mechanical strength of the substrate.

And, it is possible for the surface of the substrate to be uneven in order to eliminate occurrence of defective images caused by a so-called interference fringe pattern being apt to appear in the formed images in the case where the image formation is carried out using coherent monochromatic light such as laser beams.

In that case, the uneven surface shape of the substrate can be formed by the grinding work with means of an appropriate cutting tool, for example, having a V-form bite.

That is, said cutting tool is firstly fixed to the predetermined position of milling machine or lathe, then, for example, a cylindrical substrate is moved regularly in the predetermined direction while being rotated in accordance with the predetermined program to thereby obtain a surface-treated cylindrical substrate of a surface having irregularities in reverse V-form with a desirably pitch and depth.

The irregularities thus formed at the surface of the cylindrical substrate form a helical structure along the center axis of the cylindrical substrate. The helical structure making the reverse V-form irregularities of the surface of the cylindrical substrate may be double or treble. Or otherwise, it may be of a cross-helical structure.

Further, the irregularities at the surface of the cylindrical substrate may be composed of said helical structure and a delay line formed along the center axis of the cylindrical substrate. The cross-sectional form of the convex of the irregularity formed at the substrate surface is in a reverse V-form in order to attain controlled unevenness of the layer thickness in the minute column for each layer to be formed and secure desired close bondability and electric contact between the substrate and the layer formed directly thereon.

And as shown in FIG. 2, it is desirable for the reverse V-form to be an equilateral triangle, right-angled triangle or inequilateral triangle. Among these triangle forms, equilateral triangle form and right-angled triangle form are most preferred.

Each dimension of the irregularities to be formed at the substrate surface under the controlled conditions is properly determined having a due regard on the following points.

That is, firstly, a layer composed of, for exmple, a-Si(H,X) or poly-Si(H,X) to constitute a light receiving layer is structurally sensitive to the surface state of the layer to be formed and the layer quality is apt to largely change in accordance with the surface state.

Therefore, it is necessary for the dimention of the irregularity to be formed at the substrate surface to be determined not to invite any decrease in the layer quality.

Secondly, should there exist extreme irregularities on the free surface of the light receiving layer, cleaning in the cleaning process after the formation of visible images becomes difficult to sufficiently carry out. In addition, in the case of carrying out the cleaning with a blade, the blade will be soon damaged.

From the viewpoints of avoiding the problems in the layer formation and the electrophotographic processes, and from the conditions to prevent occurrence of the problems due to interference fringe patterns, the pitch of the irregularity to be formed at the substrate surface is preferably 0.3 to 500 μm, more preferably 1.0 to 200 μm, and, most preferably, 5.0 to 50 μm.

As for the maximum depth of the irregularity, it is preferably 0.1 to 5.0 μm, more preferably 0.3 to 3.0 μm, and, most preferably, 0.6 to 2.0 μm.

And when the pitch and the depth of the irregularity lie respectively in the above-mentioned range, the inclination of the slope of the dent (or the linear convex) of the irregularity is preferably 1° to 20°, more preferably 3° to 15°, and, most preferably, 4° to 10°.

Further, as for the maximum figure of a thickness difference based on the ununiformity in the layer thickness of each layer to be formed on such substrate surface, in the meaning within the same pitch, it is preferably 0.1 to 2.0 μm, more preferably 0.1 to 1.5 μm, and, most preferably, 0.2 μm to 1.0 μm.

In alternative, the irregularity at the substrate surface may be composed of a plurality of fine spherical dimples which are more effective in eliminating the occurrence of defective images caused by the interference fringe patterns especially in the case of using coherent monochromatic light such as laser beams.

In that case, the scale of each of the irregularities composed of a plurality of fine spherical dimples is smaller than the resolving power required for the light receiving member for use in electrophotography.

A typical method of forming the irregularities composed of a plurality of fine spherical dimples at the substrate surface will be hereunder explained referring to FIGS. 16 and 17.

Figure 4:
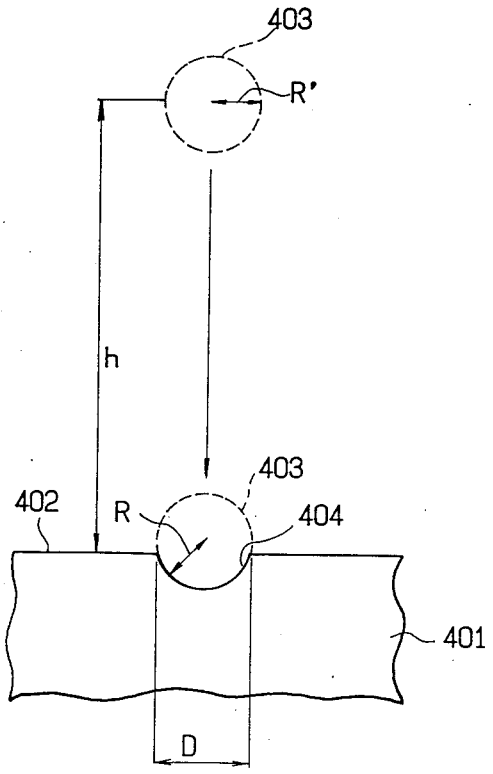
FIG. 4 and FIG. 5 are schematic explanatory views of a preferred method for preparing the substrate having the preferred surface used in the light receiving member shown in FIG. 3.

FIG. 4 is a schematic view for a typical example of the shape at the surface of the substrate in the light receiving member for use in electrophotography according to this invention, in which a portion of the uneven shape is enlarged. In FIG. 4, are shown a support 401, a support surface 402, a rigid true sphere 403, and a spherical dimple 404.

FIG. 4 also shows an example of the preferred methods of preparing the surface shape as mentioned above. That is, the rigid true sphere 403 is caused to fall gravitationally from a position at a predetermined height above the substrate surface 402 and collide against the substrate surface 402 to thereby form the spherical dimple 404. A plurality of fine spherical dimples 404 each substantially of an identical radius of curvature R and of an identical width D can be formed to the substrate surface 402 by causing a plurality of rigid true spheres 403 substantially of an identical diameter R' to fall from identical height h simultaneously or sequentially.

Figure 5:
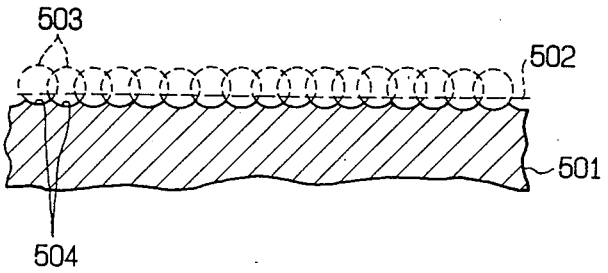

FIG. 5 shows a typical embodiment of a substrate formed with the uneven shape composed of a plurality of spherical dimples at the surface as described above.

In the embodiment shown in FIG. 5, a plurality of dimples pits 504, 504 . . . substantially of an identical radius of curvature and substantially of an identical width are formed while being closely overlapped with each other thereby forming an uneven shape regularly by causing to fall a plurality of spheres 503, 503, . . . regularly and substantially from an identical height to different positions at the surface 502 of the support 501. In this case, it is naturally required for forming the dimples 504, 504 . . . overlapped with each other that the spheres 503, 503 . . . are graviationally dropped such that the times of collision of the respective spheres 503 to the support 502 and displaced from each other.

By the way, the radius of curvature R and the width D of the uneven shape formed by the spherical dimples at the substrate surface of the light receiving member fur use in electrophotography according to this invention constitute an important factor for effectively attaining the advantageous effect of preventing occurrence of the interference fringe in the light receiving member for use in electrophotography according to this invention. The present inventors carried out various experiments and, as a result, found the following facts.

That is, if the radius of curvature R and the width D satisfy the following equation:

$$D/R \geqq 0.035$$

0.5 or more Newton rings due to the sharing interference are present in each of the dimples. Further, if they satisfy the following equation:

$$D/R \geqq 0.055$$

one or more Newton rings due to the sharing interference are present in each of the dimples.

From the foregoing, it is preferred that the ratio D/R is greater than 0.035 and, preferably, greater than 0.055 for dispersing the interference fringes resulted throughout the light receiving member in each of the dimples thereby preventing occurrence of the interference fringe in the light receiving member.

Further, it is desired that the width D of the unevenness formed by the scraped dimple is about 500 μm at the maximum, preferably, less than 200 μm and, more preferably less than 100 μm.

FIG. 3 is a schematic view illustrating a representative embodiment of the light receiving member in which is shown the light receiving member comprising the above-mentioned substrate 301 and the light receiving layer 300 constituted by a contact layer 302-1, photoconductive layer 302-2, and surface layer 303 having free surface 304.

Contact Layer 106 (or 302-1)

The contact layer 106 (or 302-1) of this invention is formed of a polycrystal material containing silicon atoms, at least one kind selected from nitrogen atoms, oxygen atoms and carbon atoms, and if necessary, hydrogen atoms or/and halogen atoms.

Further, the contact layer may contain an element for controlling conductivity.

The main object of disposing the contact layer in the light receiving member of this invention is to enhance the bondability between the substrate and the charge injection inhibition layer or between the substrate and the photoconductive layer. And, when the element for controlling the conductivity is incorporated in the contact layer, the transportation of a charge between the substrate and the charge injection inhibition layer is effectively improved.

Since the contact layer of the light receiving member in this invention is constituted with a polycrystal material and structurally minute, its adhesion with the photoconductive layer or the IR layer which is to be formed thereon is extremely ensured.

This leads the light receiving member to improve its durability and effectively prevent appearance of defective images upon using.

For incorporating various atoms in the contact layer that is, at least one kind selected from nitrogen atoms, oxygen atoms and carbon atoms; elements for controlling the conductivity in case where necessary; they may be distributed either uniformly in the entire layer region or unevenly in the direction toward its layer thickness.

In the light receiving member of this invention, the amount of nitrogen atoms, oxygen atoms, or carbon atoms to be incorporated in the contact layer is properly determined according to use purposes.

It is preferably $5\times10^{-4}$ to $7\times10$ atomic %, more preferably $1\times10^{-3}$ to $5\times10$ atomic %, and, most preferably, $2\times10^{-3}$ to $3\times10$ atomic %.

For the thickness of the contact layer, it is properly determined having a due regard to its bondability, charge transporting efficiency, and also to its producibility.

It is preferably $1\times10^{-2}$ to $1\times10$ μm, and most preferably, $2\times10^{-2}$ to 5 μm. As for the hydrogen atoms and halogen atoms to be optionally incorporated in the contact layer, the amount of hydrogen atoms or halogen atoms, or the sum of the amount of hydrogen atoms and the amount of halogen atoms in the contact layer is preferably $1\times10^{-1}$ to $7\times10$ atomic %, more preferably $5\times10^{-}$to $5\times10$ atomic %, and, most preferably, 1 to $3\times10$ atomic %.

Photoconductive Layer 103 (or 302-2)

The photoconductive layer 103 (or 302-2) is disposed on the contact layer 106 (or 302-1) as shown in FIG. 1—1 (or FIG. 3).

The photoconductive layer is formed of an A-Si(H,X) material or an A-Si(H,X) material containing oxygen atoms and/or nitrogen atoms hereinafter referred to as "A-Si(H,X) (O,N)"].

The photconductive layer has the semiconductor characteristics as under mentioned and shows a photoconductivity against irradiated light.

(i) p-type semiconductor characteristics: containing an accepted only or both the acceptor and a donor in which the relative content of the acceptor is higher;

(ii) p-type semiconductor characteristics: the content of the acceptor (Na) is lower or the relative content of the acceptor is lower in the case (i);

(iii) n-type semiconductor characteristics: containing a donor only or both the donor and an acceptor in which the relative content of the donor is higher;

(iv) n-type semiconductor characteristics: the content of donor (Nd) is lower or the relative content of the acceptor is lower in the case (iii); and (v) i-type semiconductor characteristics: $Na\simeq Nd\simeq 0$ or $Na\simeq Nd$.

In order for the photoconductive layer to be a desirable type selected from the above-mentioned types (i) to (v), it can be carried out by doping a p-type impurity, an n-type impurity or both the impurity with the photoconductive layer to be formed during its forming process while controlling the amount of such impurity.

As the element to be such impurity to be contained in the photoconductive layer, the so-called impurities in the field of the semiconductor can be mentioned, and those usable herein can include atoms belonging to the group III or the periodical table that provide p-type conductivity (hereinafter simply referred to as "group III atom") or atoms belonging to the group V of the periodical table that provide n-type conductivity (hereinafter simply referred to as "group V atom"). Specifically, the group III atoms can include B (boron), Al (aluminum), Ga (gallium), In (indium) and Tl (thallium). The group V atoms can include, for example, P (phosphor), As (arsenic), Sb (antimony) and Bi (bismuth). Among these elements, B, Ga, P and As are particularly preferred.

The amount of the group III atoms or the group V atoms to be contained in th photoconductive layer is preferably $1\times10^{-3}$ to $3\times10^{2}$ atomic ppm, more preferably, $5\times10^{-3}$ to $1\times10^{2}$ atomic ppm, and, most preferably, $1\times10^{-2}$ to 50 atomic ppm.

In the photoconductive layer, oxygen atoms or/and nitrogen atoms can be incorporated in the range as long as the characteristics required for that layer is not hindered.

In the case of incorporating oxygen atoms or/and nitrogen atoms in the entire layer region of the photoconductive layer, its dark resistance and close bondability with the substrate are improved.

The amount of oxygen atoms or/and nitrogen atoms to be incorporated in the photoconductive layer is desired to be relatively small not to deteriorate its photoconductivity.

In the case of incorporating nitrogen atoms in the photoconductive layer, its photosensitivity in addition to the above advantages may be improved when nitrogen atoms are contained together with boron atoms therein.

The amount of one kind selected from nitrogen atoms (N), and oxygen atoms (O) or the sum of the amounts for two kinds of these atoms to be contained in the photoconductive layer is preferably $5\times10^{-4}$ to 30 atomic %, more preferably, $1\times10$ to 20 atomic %, and, most preferably, $2\times10^{-2}$ to 15 atomic %.

The amount of the hydrogen atoms (H), the amount of the halogen atoms (H) or the sum of the amounts for the hydrogen atoms and the halogen atoms (H+X) to be incorporated in the photoconductive layer is preferably 1 to 40 atomic %, more preferably, 5 to 30 atomic %.

The halogen atom (X) includes, specifically, fluorine, chlorine, bromine and iodine. And among these halogen atoms, fluorine and chlorine and particularly preferred.

The thickness of the photoconductive layer is an important factor in order for the photocarriers generated by the irradiation of light having desired spectrum characteristics to be effectively transported, and it is appropriately determined depending upon the desired purpose.

It is, however, also necessary that the layer thickness be determined in view of relative and organic relationships in accordance with the amounts of the halogen atoms and hydrogen atoms contained in the layer or the characteristics required in the relationship with the thickness of other layer. Further, it should be determined also in economical viewpoints such as productivity or mass productivity. In view of the above, the thickness of the photoconductive layer is preferably 1 to 100 μm, more preferably, 1 to 80 μm, and, most preferably, 2 to 50 μm.

Surface Layer 104 (or 303)

The surface layer 104 (or 303) having the free surface 105 (or 304) is disposed on the photoconductive layer 103 (or 302-2) to attain the objects chiefly of moisture resistance, deterioration resistance upon repeating use, electrical voltage withstanding property, use environmental characteristics and durability for the light receiving member for use in electrophotography according to this invention.

The surface layer is formed of the amorphous material containing silicon atoms as the constituent element which are also contained in the layer constituent amorphous material for the photoconductive layer, so that the chemical stability at the interface between the two layers is sufficiently secured.

Typically the surface layer is formed of an amorphous material containing silicon atoms, carbon atoms, and hydrogen atoms (hereinafter referred to as "A-$(Si_xC_{1-x})_yH_{1-y}$", $x>0$ and $y<1$).

It is necessary for the surface layer for the light receiving member for use in electrophotography according to this invention to be carefully formed in order for that layer to bring about the characteristics as required.

That is, a material containing silicon atoms (Si), carbon atoms (C) and hydrogen atoms (H) as the constituent elements is structually extended from a crystalline state to an amorphous state which exhibit electrophysically properties from conductiveness to semiconductiveness and insulativeness, and other properties from photoconductiveness to in photoconductiveness according to the kind of a material.

Therefore, in the formation of the surface layer, appropriate layer forming conditions are required to be strictly chosen under which a desired surface layer composed of A-$Si_xC_{1-x}$ having the characteristics as required may be effectively formed.

For instance, in the case of disposing the surface layer with aiming chiefly at improvements in its electrical voltage withstanding property, the surface layer composed of A-$(Si_xC_{1-y})_y$: $H_{1-y}$ is so formed that it exhibits a significant electrical insulative behavior in use environment.

In the case of disposing the surface layer with aiming at improvements in repeating use characteristics and use environmental characteristics, the surface layer composed of A-$Si_xC_{1-x}$ is so formed that it has certain sensitivity to irradiated light although the electrical insulative property should be somewhat decreased.

The amount of carbon atoms and the amount of hydrogen atoms respectively to be contained in the surface layer of the light receiving member for use is electrophotography according to this invention are important factors as well as the surface layer forming conditions in order to make the surface layer accompanied with desired characteristics to attain the objects of this invention.

The amount of the carbon atoms (C) to be incorporated in the surface layer is preferably $1\times10^{-3}$ to 90 atomic %, and, most preferably, 10 to 80 atomic % respectively to the sum of the amount of the silicon atoms and the amount of the carbon atoms.

The amount of the hydrogen atoms to be incorporated in the surface layer is preferably $1\times10^{-3}$ to 40 atomic %, more preferably $5\times10^{-3}$ to 35 atomic %, and, most preferably, $1\times10^{-2}$ to 30 atomic % respectively to the sum of the amount of all the constituent atoms to be incorporated in the surface layer.

As long as the amount of the hydrogen atoms to be incorporated in the surface layer lies in the above-mentioned range, any of the resulting light receiving members for use in electrophotography becomes wealthy in significantly practically applicable characteristics and to excel the conventional light receiving members for use in electrophotography in every viewpoint.

That is, for the conventional light receiving member for use in electrophotography, that is known that when there exist certain defects within the surface layer composed of A-$(Si_xC_{1-x})_y$: $H_{1-y}$ (due to mainly dangling bonds of silicon atoms and those of carbon atoms) they give undesirable influences to the electrophotographic characteristics.

For instance, because of such defects there are often invited deterioration in the electrification characteristics due to charge injection from the side of the free surface, changes in the electrification characteristics due to alterations in the surface structure under certain use environment, for example, high moisture atmosphere, and appearance of residual images upon repeating use due to that an electric charge is injected into the surface layer from the photoconductive layer at the time of corona discharge or at the time of light irradiation to thereby make the electric charge trapped for the defects within the surface layer.

However, the above defects being present in the surface layer of the conventional light receiving member for use in electrophotography which invite various problems as mentioned above can be largely eliminated by controlling the amount of the hydrogen atoms to be incorporated in the surface layer to be less than 40 atomic %, and as a result, the foregoing problems can be almost resolved. In addition, the resulting light receiving member for use in electrophotography becomes to have extremely improved advantages especially in the electric characteristics and the repeating usability at high speed in comparison with the conventional light receiving member for use in electrophotography.

In this connection, it is an essential factor for the light receiving member for use in electrophotography of this invention that the surface layer contains the amount of the hydrogen atoms ranging in the above-mentioned range.

For the incorporation of the hydrogen atoms in said particular amount in the surface layer, it can be carried out by appropriately controlling the related conditions such as the flow rate of a starting gaseous substance, the temperature of a substrate, discharging power and the gas pressure.

Specifically, in the case where the surface layer is formed of A-$(Si_xC_{1-x})_y$: $H_{1-y}$, the "x" is preferably 0.1 to 0.99999, more preferably 0.1 to 0.99, and, most preferably, 0.15 to 0.9. And the "y" is preferably 0.6 to 0.999 more preferably 0.65 to 0.995, and, most preferably, 0.7 to 0.99.

The thickness of the surface layer in the light receiving member according to this invention is appropriately determined depending upon the desired purpose.

It is, however, also necessary that the layer thickness be determined in view of relative and organic relationships in accordance with the amounts of the halongen atoms, hydrogen atoms and other kind atoms contained in the layer or the characteristics required in the relationship with the thickness of other layer. Further, it should be determined also in economical point of view such as productivity or mass productivity. In view of the above factors, the thickness of the surface layer is preferably 0.003 to 30 μm, more preferably, 0.004 to 20 μm, and, most preferably, 0.005 to 10 μm.

By the way, the thickness of the light receiving layer 100 constituted by the photoconductive layer 103 (or 302-2 in FIG. 3) and the surface layer 104 (or 303 in FIG. 3) in the light receiving member for use in electrophotography according to this invention is appropriately determined depending upon the desired purpose.

In any case, said thickness is appropriately determined in view of relative and organic relationships between the thickness of the photoconductive layer and that of the surface layer so that the various desired characteristics for each of the photoconductive layer and the surface layer in the light receiving member for use in electrophotography can be sufficiently brought about upon the use to effectively attain the foregoing objects of this invention.

And, it is preferred that the thicknesscs of the photoconductive layer and the surface layer be determined so that the ratio of the former versus the latter lies in the range of some hundred times to some thousand times.

Specifically, the thickness of the light receiving layer 100 is preferably 3 to 100 μm, more preferably 5 to 70 μm, and, most preferably, 5 to 50 μm.

Charge Injection Inhibition Layer 107

In the light receiving member for use in electrophotography of this invention, the charge injection inhibition layer is disposed on the contact layer 106. And the contact layer is formed of A-Si(H,X) or poly-Si(H,X) containing the element for controlling the conductivity uniformly in the entire layer region or largely in the side of the substrate.

As for the element for controlling the conductivity, so-called impurities in the field of the semiconductor can be mentioned and those usable herein can include atoms belonging to the group III of the periodic table that provide p-type conductivity (hereinafter simply referred to as "group III atoms") or atoms belonging to the group V of te periodic table that provide n-type conductivity (hereinafter simply referred to as "group V atoms"). Specifically, the group III atoms can include B (boron), Al (aluminum), Ga (gallium), In (indium) and Tl (thallium), B and Ga being particularly preferred. The group V atoms can include P (phosphorus), As (arsenic), Sb (antimony), and Bi (bismuth), P and Sb being particularly preferred.

For the amount of the group III atoms or group V atoms to be contained in the charge injection inhibition layer, it is properly determined according to desired requirements. preferably $5\times10$ to $\times10^4$ atomic ppm, and, most preferably, $1\times10^2$ to $5\times10^3$ atomic ppm.

The halogen atom (X) to be contained in the charge injection inhibition layer include preferably F (fluorine), Cl (chlorine), Br (bromine), and I (iodine), F and Cl being particularly preferred.

The amount of hydrogen atoms (H), the amount of the hydrogen atoms (X) or the sum of the amounts for the hydrogen atoms and the halogen atoms (H+X) contained in the charge injection inhibition layer is preferably 1 to 40 atomic %, and, most preferably, 5 to 30 atomic %.

And said layer may contain at least one kind selected nitrogen atoms, oxygen atoms and carbon atoms in the state of being distributed uniformly in the entire layer region or partial layer region but largely in the side of the substrate.

When at least one kind selected from nitrogen atoms, oxygen atoms and carbon atoms is incorporated in the charge injection inhibition layer, not only the mutual contact between the contact layer and the charge injection inhibition layer and the bondability between the charge injection inhibition layer and the photoconductive layer but also the adjustment of band gap for that layer are effectively improved.

As for the amount of at least one kind selected from nitrogen atoms, oxygen atoms and carbon atoms is properly determined according to desired requirements. However, it is preferably $1\times10^{-3}$ to 50 atomic %, more preferably, $2\times10^{-3}$ atomic % to 40 atomic %, and, most preferably, $3\times10^{-3}$ to 30 atomic %.

For the thickness of the charge injection inhibition layer, it is preferably $1\times10^{-2}$ to 10 μm, more preferably, $5\times10^{-2}$ to 8 μm, and, most preferably, $1\times10^{-1}$ to 5 μm in the viewpoints of bringing about electrophotographic characteristics and economical effects.

IR Layer 108

In the light receiving member for use in electrophotography of this invention, the IR layer 108 is formed of A-SiGe(H,X).

When germanium atoms is incorporated in the IR layer, the light receiving member for use in electrophotography of this invention becomes more sensitive to light of wavelengths broadly ranging from short wavelength to long wavelength covering visible light and particularly it becomes suitable for the matching property with a semiconductor laser. And, it also becomes quickly responsive to light.

As for the germanium atoms to be contained in the IR layer, they may be distributed uniformly in its entire layer region or unevenly in the direction toward the layer thickness of its entire layer region.

However, in any case, it is necessary for the germanium atoms to be distributed uniformly in the direction parallel to the surface of the substrate in order to provide the uniformness of the characteristics to be brought out.

In one of the preferred embodiments, the germanium atoms are contained in such state that the distributing concentration of these atoms is changed in the way of being decreased from the layer region near the substrate toward the layer region near the charge injection inhibition layer. In this case, the affinity between the IR layer and the charge injection inhibition becomes excellent. And, as later detailed, when the distributing concentration of the germanium atoms is made significantly large in the layer region adjacent to the substrate, the IR layer becomes to substantially and completely absorb the light of long wavelength that can be hardly absorbed by the photoconductive layer in the case of using a semiconductor laser as the light source. As a result, the occurrence of the interference caused by the light reflection from the surface of the substrate can be effectively prevented.

For the amount of germanium atoms to be contained in the IR layer, it is properly determined according to desired requirements. However, it is preferably 1 to $1\times10^6$ atomic ppm, more preferably $10^2$ to $9.5\times10^5$ atomic ppm, and, most preferably, $5\times10^2$ to $8\times10^5$ atomic ppm based on the total amount of silicon atoms and germanium atoms.

Further, the IR layer may contain an element for controlling the conductivity.

As for the element for controlling the conductivity to be contained in said layer, the group III or Group V atoms can be used likewise in the case of the above-mentioned charge injection inhibition layer.

When the group III or group V atoms is incorporated in the IR layer, the inhibitation of a charge injection from the substrate, or the improvement in the transfer efficiency of an optically pumped charge is brought about.

For the amount of the group III or group V atoms, it is preferably $1\times10^{-2}$ to $5\times10^5$ atomic ppm, more preferably $5\times10^{-1}$ to $1\times10^4$ atomic ppm, and, most preferably, 1 to $5\times10^3$ atomic ppm.

Further more, the IR layer may contain at least one kind selected from nitrogen atoms, oxygen atoms and carbon atoms.

When at least one kind selected from nitrogen atoms, oxygen atoms and carbon atoms is incorporated in the IR layer, the bondability between the substrate and that layer or/and between that layer and the charge injection inhibition layer and the adjustment of band gap for that layer are effectively improved.

For the amount of at least one kind selected from nitrogen atoms, oxygen atoms and carbon atoms, it is preferably $1\times10^{-2}$ to 40 atoms %, more preferably $5\times10^{-2}$ to 30 atomic %, and, most preferably, $1\times10^{-1}$ to 25 atomic %.

And as for the thickness of the IR layer, it is preferably 30 Å to 50 μm, more prferably 40 Å to 40 μm. and, most preferably, 50 Å to 30 μm.

Preparation of Layers

The method of forming the light receiving layer 100 of the light receiving member will be now explained.

Each of the layers to constitute the light receiving layer of the light receiving member of this invention is properly prepared by vacuum deposition method utilizing the discharge phenomena such as glow discharging, sputtering and ion plating methods wherein relevant gaseous starting materials are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the light receiving members having desired properties are relatively easy, and hydrogen atoms, halogen atoms and other atoms can be introduced easily together with silicon atoms. The glow discharging method and the sputtering method may be used together in one identical system.

Preparation of Contact Layer, IR Layer, Charge Injection Inhibition Layer, and Photoconductive Layer Basically, when the contact layer constituted with poly-Si(H,X) or/and the photoconductive layer constituted with A-Si(H,X) are formed, for example, by the glow discharging process, gaseous starting material capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of A Si(H,X) or/and poly-Si(H,X) are formed on the surface of a substrate placed in a deposition chamber.

In the case of forming such layers by the reactive sputtering process, they are formed by using a Si target and by introducing a gas or gases material capable of supplying halogen atoms (X) or/and hydrogen atoms (H), if necessary, together with an inert gas such as He or Ar into a sputtering deposition chamber to thereby form a plasma atmosphere and then sputtering the Si target.

In the case of forming the IR layer constituted with A-SiGe(H,X) by the glow discharging process, gaseous starting material capable of supplying silicon atoms (Si) is introduced together with gaseous starting material capable of supplying germanium atoms (Ge), and if necessary gaseous starting material for introducing hydrogen atoms (H) and/or halogen atoms (X) into a deposition chamber the inside pressure of which can be reduced, glow discharge is generated in the deposition chamber, and a layer composed of A-SiGe(H,X) is formed on the surface of the substrate placed in the deposition chamber.

To form the IR layer of A-SiGe(H,X) by the reactive sputtering process, a single target composed of silicon, or two targets (the said target and a target composed of germanium), further a single target composed of silicon and germanium is subjected to sputtering in atmosphere of an inert gas such as He or Ar, and if necessary gaseous starting material capable of supplying germanium atoms diluted with an inert gas such as He or Ar and/or gaseous starting material for introducing hydrogen atoms (H) and/or halogen atoms (X) are introduced into the sputtering deposition chamber thereby forming a plasma atmosphere with the gas.

The gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

The gaseous starting material for supplying Ge can include gaseous or gasifiable germanium hydrides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, and $Ge_9H_{20}$, etc., $GeH_4$, $Ge_2H_6$, and $Ge_3H_8$ being particularly preferred in view of the easy layer forming work and the good efficiency for the supply of Ge.

Further, various halogen compounds can be mentioned as the gaseous starting material for introducing the halogen atoms and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2F_6$, $SiCl_4$, and $SiBr_4$.

The use of the gaseous or gasifiable silicon halides as described above for forming a light receiving layer composed of poly-Si or A-Si containing halogen atoms as the constituent atoms by the glow discharging process is particularly advantageous since such layer can be formed with no additional use of gaseous starting material for supplying Si such as silicon hydride.

And, basically, in the case of forming a light receiving layer containing halogen atoms by the glow discharging process, for example, a mixture of a gaseous silicon halide substance as the starting material for supplying Si and a gas such as Ar, $H_2$ and He is introduced into the deposition chamber having a substrate in a predetermined mixing ratio and at a predetermined gas flow rate, and the thus introduced gases are exposed to the action of glow discharge to thereby cause a plasma resulting in forming said layer on the substrate. And, for incorporating hydrogen atoms in said layer, an appropriate gaseous starting material for supplying hydrogen atoms can be additionally used.

In the case of forming the IR layer, the above-mentioned halides or halogen-containing silicon compounds can be used as the effective gaseous starting material for supplying halogen atoms. Other examples of the starting material for supplying halogen atoms can include germanium hydride halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, and $GeH_3I$; and germanium halides such as $GeF_4$, $GeCl_4$, $GeBr_4$, $GeI_4$, $GeF_2$, $GeCl_2$, $GeBr_2$, and $GeI_2$. They are in the gaseous form or gasifiable substances.

And in any case, one of these gaseous or gasifiable starting materials or a mixture of two or more of them in a predetermined mixing ratio can be selectively used.

As above mentioned, in the case of forming a layer composed constituted with, for example, poly-Si(H,X)

or A-Si(H,X) by the reactive sputtering process, such layer is formed on the substrate by using an Si target and sputtering the Si target in a plasma atmosphere.

And, in order to form such layer by the ion-plating process, the vapor of polycrystal silicon or single crystal silicon is allowed to pass through a desired gas plasma atmosphere. The silicon vapor is produced by heating the polycrystal silicon or single crystal silicon held in a boat. The heating is accomplished by resistance heating or in accordance with the electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms in accordance with the sputtering process, a feed gas to liberate hydrogen is introduced into the deposition chamber in which a plasma atmosphere of the gas is produced. The feed gas to liberate hydrogen atoms includes $H_2$ gas and the above-mentioned silanes.

As for the gaseous or gasifiable starting material for incorporating halogen atoms in the IR layer, charge injection inhibition layer or photoconductive layer, the foregoing halide, halogen-containing silicon compound or halogen-containing germanium compound can be effectively used. Other effective examples of said material can include hydrogen halides such as HF, HCl, HBr and HI and halogen-substituted silanes such as $SiH_2F_2$, $SiH_2I_2$, $SiH_2Cl_2$, $SiHCl_3$, $SiH_2Br_2$ and $SiHBr_3$, which contain hydrogen atom as the constituent element and which are in the gaseous state or gasifiable substances. The use of the gaseous or gasifiable hydrogen-containing halides is particularly advantageous since, at the time of forming a light receiving layer, the hydrogen atoms, which are extremely effective in view of controlling the electrical or photoelectrographic properties, can be introduced into that layer together with halogen atoms.

The structural introduction of hydrogen atoms into the layer can be carried out by introducing, in addition to these gaseous starting materials, $H_2$, or silicon hydrides such as $SiH_4$, $SiH_6$, $Si_3H_6$, $Si_4H_{10}$, etc. into the deposition chamber together with a gaseous or gasifiable silicon-containing substance for supplying Si, and producing a plasma atmosphere with these gases therein.

The amount of the hydrogen atoms (H) and/or the amount of the halogen atoms (X) to be contained in the layer are adjusted properly by controlling related conditions, for example, the temperature of a substrate, the amount of a gaseous starting material capable of supplying the hydrogen atoms or the halogen atoms into the deposition chamber and the electric discharging power.

In order to incorporate the group III atoms or the group V atoms, and, oxygen atoms, nitrogen atoms or carbon atoms in the IR layer, the charge injection inhibition layer or the photoconductive layer using the glow discharging process, reactive sputtering process or ion plating process, the starting material capable of supplying the group III or group V atoms, and, the starting material capable of supplying oxygen atoms, nitrogen atoms or carbon atoms are selectively used together with the starting material for forming the IR layer, the charge injection inhibition layer or the photoconductive layer upon forming such layer while controlling the amount of them in that layer to be formed.

As the starting material to introduce the atoms (O,N,C), many gaseous or gasifiable substances containing any of oxygen, carbon, and nitrogen atoms as the constituent atoms can be used. Likewise, as for the starting material to introduce the group III or group V atoms, many gaseous or gasifiable substances can be used.

For example, referring to the starting material for introducing oxygen atoms, most of those gaseous or gasifiable materials which contain at least oxygen atoms as the constituent atoms can be used.

And, it is possible to use a mixture of a gaseous starting material containing silicon atoms (Si) as the constituent atoms, a gaseous starting material containing oxygen atoms (O) as the constituent atom and, as required, a gaseous starting material containing hydrogen atoms (H) and/or halogen atoms (X) as the constituent atoms in a desired mixing ratio, a mixture of gaseous starting material containing silicon atoms (Si) as the constituent atoms and a gaseous starting material containing oxygen atoms (O) and hydrogen atoms (H) as the constituent atoms in a desired mixing ratio, or a mixture of gaseous starting material containing silicon atoms (Si) as the constituent atoms and a gaseous starting material containing silicon atoms (Si), oxygen atoms (O) and hydrogen atoms (H) as the constituent atoms.

Further, it is also possible to use a mixture of a gaseous starting material containing silicon atoms (Si) and hydrogen atoms (H) as the constituent atoms and a gaseous starting material containing oxygen atoms (O) as the constituent atoms.

Specifically, there can be mentioned, for example, oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

Likewise, as the starting material for introducing nitrogen atoms, most of gaseous or gasifiable materials which contain at least nitrogen atoms as the constituent atoms can be used.

For instance, it is possible to use a mixture of a gaseous starting material containing silicon atoms (Si) as the constituent atoms, a gaseous starting material containing nitrogen atoms (N) as the constituent atoms and, optionally, a gaseous starting material containing hydrogen atoms (H) and/or halogen atoms (X) as the constituent atoms in a desired mixing ratio, or a mixture of a starting gaseous material containing silicon atoms (Si) as the constituent atoms and a gaseous starting material containing nitrogen atoms (N) and hydrogen atoms (H) as the constituent atoms also in a desired mixing ratio.

Alternatively, it is also possible to use a mixture of a gaseous starting material containing nitrogen atoms (N) as the constituent atoms and a gaseous starting material containing silicon atoms (Si) and hydrogen atoms (H) as the constituent atoms.

The starting material that can be used effectively as the gaseous starting material for introducing the nitrogen atoms (N) used upon forming the layer containing nitrogen atoms can include gaseous or gasifiable nitrogen, nitrides and nitrogen compounds such as azide compounds comprising N as the constituent atoms or N and H as the constituent atoms; for example, nitrogen ($N_2$), ammonia ($NH_3$), hydrazine ($H_2NNH_2$), hydrogen azide ($HN_3$) and ammonium azide ($NH_4N_3$). In addition, nitrogen halide compounds such as nitrogen trifluoride (F3N) and nitrogen tetrafluoride ($F_4N_2$) can also be mentioned in that they can also introduce halogen atoms (X) in addition to the introduction of nitrogen atoms (N).

Further, as for the starting material for introducing carbon atoms, gaseous or gasifiable materials containing carbon atoms as the constituent atoms can be used.

And it is possible to use a mixture of gaseous starting material containing silicon atoms (Si) as the constituent atoms, gaseous starting material containing carbon atoms (C) as the constituent atoms and, optionally, gaseous starting material containing hydrogen atoms (H) and/or halogen atoms (X) as the constituent atoms in a desired mixing ratio, a mixture of gaseous starting material containing silicon atoms (Si) as the constituent atoms and gaseous starting material containing carbon atoms (C) and hydrogen atoms (H) as the constituent atoms also in a desired mixing ratio, or a mixture of gaseous starting material containing silicon atoms (Si) as the constituent atoms and gaseous starting material comprising silicon atoms (Si).

Those gaseous starting materials that are effectively usable herein can include gaseous silicon hydrides containing carbon atoms (C) and hydrogen atoms (H) as the constituent atoms, such as silanes, for example, $SiH_4$, $Si_2H_6$, $Si_3H_8$ and $Si_4H_{10}$, as well as those containing carbon atoms (C) and hydrogen atoms (H) as the constituent atoms, for example, saturated hydrocarbons of 1 to 4 carbon atoms, ethylenic hydrocarbons of 3 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition to these gaseous starting materials, $H_2$ can of course be used as the gaseous starting material for introducing hydrogen atoms (H).

In order to form the IR layer, the charge injection prohibition layer or the photoconductive layer incorporated with the group III or group V atoms using the glow discharging process, reactive sputtering process or ion plating process, the starting material for introducing the group III or group V atoms is used together with the starting material for forming such upon forming that layer while controlling the amount of them in the layer to be formed.

For instance, in the case of forming a layer composed of poly-Si(H,X) or of A Si(H,X) containing the group III or group V atoms, namely poly-SiM(H,X) or A-SiM(H,X) wherein M stands for the group III or group V atoms, by using the glow discharging, the starting gases material for forming such layer are introduced into a deposition chamber in which a substrate being placed, optionally being mixed with an inert gas such as Ar or He in a predetermined mixing ratio, and the thus introduced gases are exposed to the action of glow discharge to thereby cause a gas plasma resulting in forming a layer composed of a-SiM(H,X) on the substrate.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. In addition, $AlCl_3$, $CaCl_3$, $Ga(CH_3)_2$, $InCl_3$, $TlCl_3$ and the like can also be mentioned.

Referring to the starting material for introducing the group V atoms and, specifically, to the phosphorus atom introducing materials, they can include, for example, phosphor hydrides such as $PH_3$ and $P_2H_6$ and phosphor halide such as $PH_4I$, $PF_3$, $PF_5$, $PCl_3$, $PCl_5$, $PBr_3$, $PBr_5$ and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $SiCl_3$ and $BiBr_3$ can also be mentioned to as the effective starting material for introducing the group V atoms.

The amount of the group III or group V atoms to be contained in the IR layer, the charge injection prohibition layer or the photoconductive layer are adjusted properly by controlling the related conditions, for example, the temperature of a substrate, the amount of a gaseous starting material capable of supplying the group III or group V atoms, the gas flow rate of such gaseous starting material, the discharging power, the inner pressure of the deposition chamber, etc.

The conditions upon forming the constituent layers of the light receiving member of the invention, for example, the temperature of the support, the gas pressure in the deposition chamber, and the electric discharging power are important factors for obtaining the light receiving member having desired properties and they are properly selected while considering the function of each of the layers to be formed. Further, since these layer forming conditions may be varied depending on the kind and the amount of each of the atoms contained in the layer, the conditions have to be determined also taking the kind or the amount of the atoms to be contained into consideration.

Specifically, the conditions upon forming the constituent layer of the light receiving member of this invention are different according to the kind of the material with which the layer is to be constituted.

In the case of forming the contact layer which is constituted with a poly-Si material, and the charge injection inhibition layer which is constituted also with a poly-Si material in case where necessary, the relationship between the temperature of a substrate and the electrical discharging power is extremely important.

That is, when the temperature of the substrate is adjusted to be in the range from 200° to 350° C., the electrical discharging power is adjusted to be preferably in the range from 1100 to 5000W/cm$^2$, and more preferably, in the range 1500 to 4000W/cm$^2$. And, when the temperature of the substrate is adjusted to be in the range from 350° to 700° C., the electrical discharging power is adjusted to be preferably in the range from 100 to 5000W/cm$^2$, and more preferably in the range from 200 to 4000W/cm$^2$.

And as for the gas pressure in the deposition chamber in the above case, it is preferably $10^{-3}$ to $8\times10^{-1}$ Torr, and more preferably, $5\times10^{-3}$ to $5\times10^{-1}$ Torr.

On the other hand, in the case of forming the photoconductive layer, the charge injection inhibition layer, and the IR layer which are constituted with an A-Si material, the temperature of the substrate is usually from 50° to 350° C., preferably, from 50° to 300° C., most suitably 100° to 250° C.; the gas pressure in the deposition chamber is usually from $1\times10^{-2}$ to 5 Torr, preferably, from $1\times10^{-2}$ to 3 Torr, most suitably from $1\times10^{-1}$ to 1 Torr; electrical discharging power is preferably from 10 to 1000 W/cm$^2$, and more preferably, from 20 to 500W/cm$^2$.

In any case, the actual conditions for forming the layer such as temperature of the support, discharging power and the gas pressure in the deposition chamber cannot usually be determined with ease independent of each other. Accordingly, the conditions optimal to the layer formation are desirably determined based on relative and organic relationships for forming the corresponding layer having desired properties.

Preparation of Surface Layer

The surface layer 104 in the light receiving member for use in electrophotography according to this invention is constituted with an amorphous material composed of A-$(Si_xC_{1-x})_y$: $H_{1-y}$ [x>0, y<1] which contains $1\times10^{-3}$ to 40 atomic % of hydrogen atoms and is disposed on the above-mentioned photoconductive layer.

The surface layer can be properly prepared by vacuum deposition method utilizing the discharge phenomena such as flow discharging, sputtering or ion plating wherein relevant gaseous starting materials are selectively used as well as in the above-mentioned cases for preparing the photoconductive layer.

However, the glow discharging method or sputtering method is suitable since the control for the condition upon preparing the surface layer having desired properties are relatively easy, and hydrogen atoms and carbon atoms can be introduced easily together with silicon atoms. The glow discharging method and the sputtering method may be used together in on identical system.

Basically, when a layer constituted with A-$(Si_xC_{1-x})_y$: $H_{1-y}$ is formed, for example, by the glow discharging method, gaseous starting material capable of supplying silicon atoms (Si) are introduced together with a gaseous starting material for introducing hydrogen atoms (H) and/or halogen atoms (X) into a deposition chamber the inside pressure of which can be reduced, glow discharge is generated in the deposition chamber, and a layer constituted with A-$(Si_xC_{1-x})_y$: $H_{1-y}$ containing $1\times10^{-3}$ to 40 atomic % of hydrogen atoms is formed on the surface of a substrate placed in the deposition chamber.

As for the gaseous starting materials for supplying silicon atoms (Si) and/or hydrogen atoms (H), the same gaseous materials as mentioned in the above cases for preparing photoconductive layer can be used as long as they do not contain any of halogen atoms, nitrogen atoms and oxygen atoms.

That is, the gaseous starting material usable for forming the surface layer can include almost any kind of gaseous or gasifiable materials as far as it contains one or more kinds selected from silicon atoms, hydrogen atoms and carbon atoms as the constituent atoms.

Specifically, for the preparation of the surface layer, it is possible to use a mixture of gaseous starting material containing silicon atoms (Si) as the constituent atoms, gaseous starting material containing carbon atoms (C) as the constituent atoms and, optionally, gaseous starting material containing hydrogen atoms (H) as the constituent atoms in a desired mixing ratio, a mixture of gaseous starting material containing silicon atoms (Si) as the constituent atoms and gaseous starting material containing carbon atoms (C) and hydrogen atoms (H) as the constituent atoms also in a desired mixing ratio, or a mixture of gaseous starting material containing silicon atoms (Si) as the constituent atoms and gaseous starting material comprising silicon atoms (Si) in the glow discharging process as described above.

Those gaseous starting materials that are effectively usable herein can include gaseous silicon hydrides containing carbon atoms (C) and hydrogen atoms (H) as the constituent atoms, such as silanes, for example, $SiH_4$, $Si_2H_6$, $Si_3H_8$ and $Si_4H_{10}$, as well as those containing carbon atoms (C) and hydrogen atoms (H) as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition to these gaseous starting materials, $H_2$ can of course be used as the gaseous starting material for introducing hydrogen atoms (H).

In the case of forming the surface layer by way of the sputtering process, it is carried out by using a single crystal or polycrystalline Si wafer, a C (graphite) wafer or a wafer containing a mixture of Si and C as a target and sputtering them in a desired gas atmosphere.

In the case of using, for example, an Si wafer as a target, a gaseous starting material for introducing carbon atoms (C) is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

The conditions upon forming the surface layer constituted with an amorphous material composed of A-$(Si_xC_{1-x})_y$: $H_{1-y}$ which contains $1\times10^{-3}$ to 40 atomic % of hydrogen atoms, for example, the temperature of the substrate, the gas pressure in the deposition chamber and the electric discharging power are important factors for obtaining a desirable surface layer having desired properties and they are properly selected while considering the functions of the layer to be formed. Further, since these layer forming conditions may be varied depending on the kind and the amount of each of the atoms contained in the light receiving layer, the conditions have to be determined also taking the kind or the amount of the atoms to be contained into consideration.

Specifically, the temperature of the substrate is preferably from 50° to 350° C. and, most preferably, from 100° to 300° C. The gas pressure in the deposition chamber is preferably from 0.01 to 1 Torr and, most preferably, from 0.1 to 0.5 Torr. Further, the electrical discharging power is preferably from 10 to 1000W/cm$^2$, and, most preferably, from 20 to 500W/cm$^2$.

However, the actual conditions for forming the surface layer such as the temperature of a substrate, discharging power and the gas pressure in the deposition chamber can not usually be determined with ease independent of each other. Accordingly, the conditions optimal to the formation of the surface layer are desirably determined based on relative and organic relationships for forming the surface layer having desired properties.

DESCRIPTION OF THE PREFERRED EMBODIMENTS

The invention will be described more specifically while referring to Examples 1 through 14, but the invention is not intended to limit the scope only to these examples.

Figure 6:
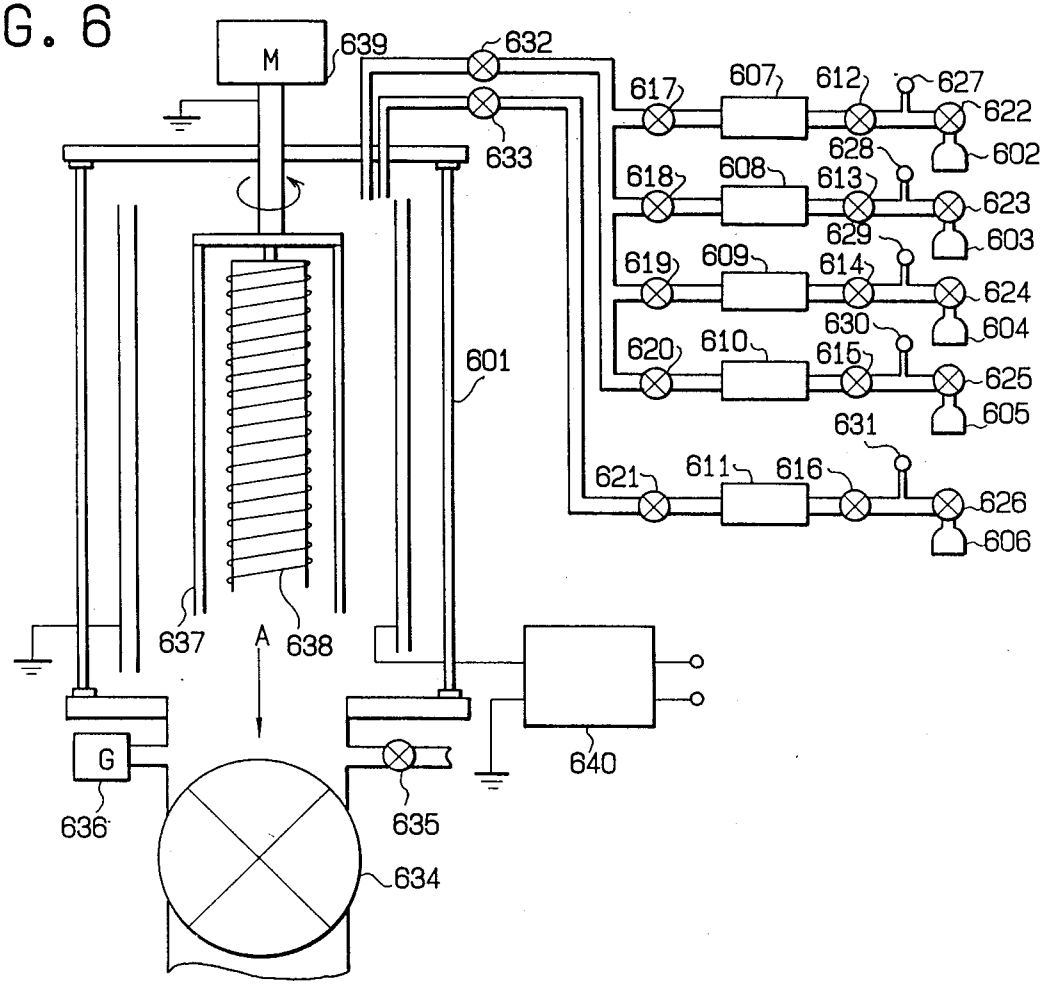
FIG. 6 is a schematic explanatory view of a fabrication apparatus for preparing the light receiving member for use in electrophotography according to this invention.

In each of the examples, the light receiving layer was formed by using the glow discharging process. FIG. 6 shows the apparatus for preparing the light receiving member according to this invention.

Gas reservoirs 602, 603, 604, 605, and 606 illustrated in the figure are charged with gaseous starting materials for forming the respective layers in the light receiving member for use in electrophotography according to this invention, that is, for instance, $SiH_4$ gas (99.999% purity) in the reservoir 602, $B_2H_6$ gas (99.999% purity) diluted with $H_2$(referred to as "$B_2H_6/H_2$") in the reservoir 2403, $H_2$ gas (99.99999% purity) in the reservoir 604, NO gas (99.999% purity) in the reservoir 605, and $CH_4$ gas (99.99% purity) in the reservoir 606.

Prior to the entrance of these gases into a reaction chamber 601, it is confirmed that valves 622–626 for the gas reservoirs 602–606 and a leak valve 635 are closed and that inlet valves 612–616, exit valves 617–621, and sub-valves 632 and 633 are opened. Then, a main valve 634 is at first opened to evacuate the inside of the reaction chamber 601 and gas piping.

Then, upon observing that the reading on the vacuum 636 became about $5\times10^{-6}$ Torr, the sub-valves 632 and 633 and the exit valves 617 through 621 are closed.

Now, reference is made to the example shown in FIG. 1—1 in the case of forming the photo receiving layer on an Al cylinder as a substrate 637.

At first, $SiH_4$ gas from the gas reservoir 602, $H_2$ gas from the gas reservoir 2404, and NO gas from the gas reservoir 605 are caused to flow into mass flow controllers 607, 609 and 610 respectively by opening the inlet valves 612, 614, and 615, controlling the pressure of exit pressure gauges 627, 629, and 630 to 1 kg/cm$^2$. Subsequently, the exit valves 617, 619, and 620, and the sub-valve 632 are gradually opened to enter the gases into the reaction chamber 601. In this case, the exit valves 617, 619, and 620 are adjusted so as to attain a desired value for the ratio among the $SiH_4$ gas flow rate, NO gas flow rate, and $H_2$ gas flow rate, and the opening of the main valve 634 is adjusted while observing the reading on the vacuum gauge 636 so as to obtain a desired value for the pressure inside the reaction chamber 601. Then, after confirming that the temperature of the 637 has been set by a heater 648 within a range from 50° to 350° C., a power source 640 is set to a predetermined electrical power to cause glow discharging in the reaction chamber 601, thereby forming, at first, a contact layer 106 containing oxygen atoms on the substrate cylinder 2437. When the layer 106 has reached a desired thickness, the exit valve 620 is completely closed to stop NO gas into the deposition chamber 601. At the same time, the flow rate of $SiH_4$ gas and the flow rate of $H_2$ gas are controlled by regulating the exit valves 617 and 619 and the layer formation process is continued to thereby form a photoconductive layer without containing oxygen atoms having a desired thickness on the previously formed contact layer.

In the case of forming a photoconductive layer containing oxygen atoms and/or boron atoms, the flow rate for the gaseous starting material to supply such atoms in appropriately controlled in stead of closing the exit valves 618 and/or 620.

In the case where halogen atoms are incorporated in the contact layer 106 and the photoconductive layer 103, for example, $SiF_4$ gas is fed into the reaction chamber 601 in addition to the gases as mentioned above.

And it is possible to further increase the layer forming speed according to the kind of a gas to be selected. For example, in the case where the contact layer 106 and the photoconductive layer 103 are formed using $Si_2H_6$ gas in stead of the $SiH_4$ gas, the layer forming speed can be increased by a few holds and as a result, the layer productivity can be rised.

In order to form the surface layer 104 or the resulting photoconductive layer, for example, $SiH_4$ gas, $CH_4$ gas and if necessary, a dilution gas such as $H_2$ gas are introduced into the reaction chamber 601 by operating the corresponding valves in the same manner as in the case of forming the photoconductive layer and glow discharging is caused therein under predetermined conditions to thereby form the surface layer.

In that case, the ambunt of the carbon atoms to be incorporated in the surface layer can be properly controlled by appropriately changing the flow rate for the $SiH_4$ gas and that for the $CH_4$ gas respectively to be introduced into the reaction chamber 601. As for the amount of the hydrogen atoms to be incorporated in the surface layer, it can be properly controlled by appropriately changing the flow rate of the $H_2$ gas to be introduced into the reaction chamber 601.

All of the exit valves other than those required for upon forming the respective layers are of course closed. Further, upon forming the respective layers, the inside of the system is once evacuated to a high vacuum degree as required by closing the exit valves 617 through 621 while entirely opening the sub-valve 632 and entirely opening the main valve 634.

Further, during the layer forming operation, the Al cylinder as substrate 637 is rotated at a predetermined speed by the action of the motor 639.

EXAMPLE 1

A light receiving member for use in electrophotography having a light receiving layer disposed on an Al cylinder having a mirror grinded surface was prepared under the layer forming conditions shown in Table 1 using the fabrication apparatus shown in FIG. 6.

And, a sample having only a contact layer on the same king Al cylinder respectively as in the above case is prepared in the same manner for forming the contact layer in the above case using the same kind fabrication apparatus as shown in FIG. 6.

For the resulting light receiving member (hereinafter, this kind light receiving member is referred to as "drum"), it was set with the conventional electrophotographic copying machine, and electrophotographic characteristics such as initial electrification efficiency, residual voltage and appearance of a ghost were examined, then decrease in the electrification efficiency, deterioration on photsensitivity and increase of defective images after 1,500 thousand times repeated shots were respectively examined.

Further, the situation of an image flow on the drum under high temperature and high humidity atmosphere at 35° C. and 85% humidity was also examined.

As for the resulting drum, upper part, middle part and lower part of its image forming part were cut off, and was engaged in quantitative analysis by SIMS to analize the content of hydrogen atoms incorporated in the surface layer in each of the cut-off parts.

As for the resulting sample having only the contact layer, upper part, middle part and lower part respectively in the generatrix direction were cut off, and were subjected to the measurement of diffraction patterns corresponding to Si (111) near 27° of the diffraction angle by the conventional X-ray diffractometer to examine the existence of crystallinity.

The results of the various evaluations, the results of the quantitative analysis of the content of the hydrogen atoms, and the situations of crystallinity for the samples are as shown in Table 2.

As Table 2 illustrates, considerable advantages on items of initial electrification efficiency, effective image flow and sensitivity deterioration were acknowledged.

COMPARATIVE EXAMPLE 1

Except that the layer forming conditions changed as shown in Table 3, the drum and the sample were made under the same fabrication apparatus and manner as Example 1 and were provided to examine the same items. The results are shown in Table 4. As the Table 4 illustrates, much defects on various items were acknowledged compared to the case of Example 1.

EXAMPLE 2

A light receiving member for use in electrophotography having a light receiving layer disposed on an Al cylinder having a mirror grinded surface was prepared under the layer forming conditions shown in Table 5 using the fabrication apparatus shown in FIG. 6.

And, a sample having only a contact layer on the same kind Al cylinder as in the above case was prepared in the same manners for forming the contact layer in the above case using the same kind fabrication apparatus as shown in FIG. 6.

For the resulting light receiving member, it was set with the conventional electrophotographic copying machine, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

As for the resulting light receiving member, upper part, middle part and lower part of its image forming part were cut off, and were engaged in quantitative analysis by SIMS to analize the content of hydrogen atoms incorporated in the surface layer in each of the cut-off parts.

As for the resulting second sample having only the contact layer, upper part, middle part and lower part respectively in the generatrix direction were cut off for each sample, and were subjected to the measurement of diffraction patterns corresponding to Si (111) near 27° of the diffraction angle by the conventional X-ray diffractometer to examine the existence of crystallinity.

The results of the various evaluation, the results of the quantitative analysis of the content of the hydrogen atoms, and the situations of crystallinity for the samples are as shown in Table 6.

As Table 6 illustrates considerable advantages on items of initial electrification efficiency, effective image flow and sensitivity deterioration were acknowledged.

COMPARATIVE EXAMPLE 2

Except that the layer forming conditions changed as shown in Table 7, the drums and the samples were made under the same fabrication apparatus and manner as Example 2 and were provided to examine the same items. The results are shown in Table 8. As the Table 8 illustrates, much defects on various items were acknowledged compared to the case of Example 2.

EXAMPLE 3

A light receiving member for use in electrophotography having a light receiving layer 100 disposed on an Al cylinder having a mirror grinded surface was prepared under the layer forming conditions shown in Table 9 using the fabrication apparatus shown in FIG. 6.

And a sample having only a contact layer on the same kind Al cylinder as in the above case was prepared in the same manner for forming the surface layer in the above case using the same kind fabrication apparatus as shown in FIG. 6.

Likewise, another sample having only a contact was prepared.

For the resulting light receiving member, it was set with the conventional electrophotographic copying machine, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow or the drum under high temperature and high humidity atmosphere at 35° C. and 85% humidity was also examined.

As for the resulting light receiving member, upper part, middle part and lower part of its image forming part were cut off, and were engaged in quantitative analysis by SIMS to analize the content of hydrogen atoms incorporated in the surface layer in each of the cut-off parts. And they were subjected to the analysis of the element profiles in the thicknesswise direction of boron atoms and oxygen atoms in the charge injection inhibition layer.

As for the sample, upper part, middle part and lower part respectively in the generatrix direction were cut off, and were subjected to the measurement of diffraction patterns corresponding to Si (111) near 27° of the diffraction angle by the conventional X-ray diffractometer to examine the existence of crystallinity.

The results of the various evaluations, the results of the quantitative analysis of the content of the hydrogen atoms and the situation of crystallinity for the samples are shown in Table 10.

Figure 9:
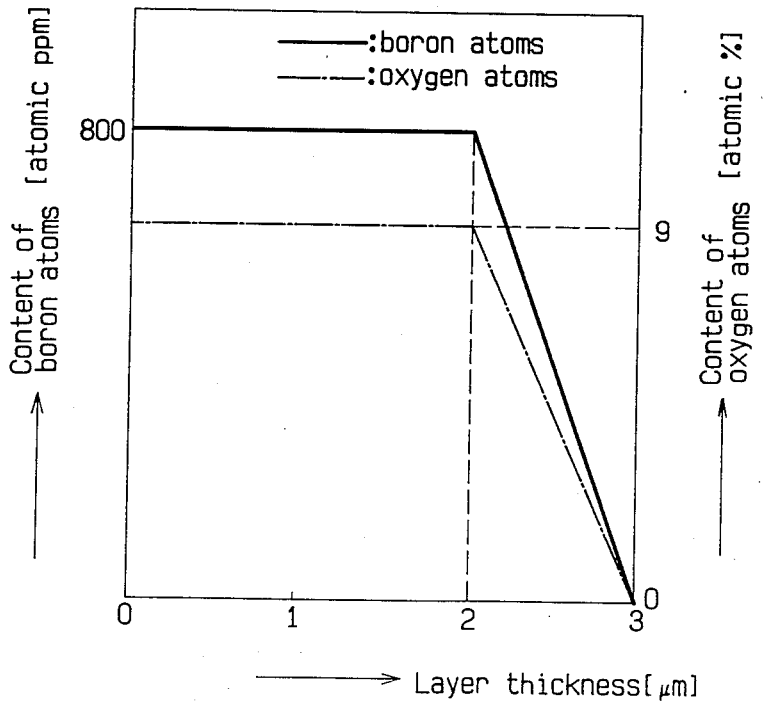
FIG. 9 is a view illustrating the thicknesswise distribution of boron atoms and oxygen atoms in the charge injection inhibition layer in Example 2.

And, the elements profiles in the thicknesswise direction of the boron atoms (B) and the oxygen atoms (O) are shown in FIG. 9.

As Table 10 illustrates, considerable advantages on items of initial electrification efficiency, effective image flow and sensitivity deterioration were acknowledged.

EXAMPLE 4

(Containing Comparative Example 3)

Multiple drums and samples for analysis were provided under the same conditions as in Example 2, except the conditions for forming a surface layer were changed to those shown in Table 11.

As a result of subjecting these drums and samples to the same evaluations and analyses as in Example 2, the results shown in Table 12 were obtained.

EXAMPLE 5

With the layer forming conditions for a photoconductive layer changed to the figures of Table 13, multiple drums having a light receiving layer under the same conditions as in Example 2 were provided. These drums were examined by the same procedures as in Example 2. The results are shown in Table 14.

EXAMPLE 6

With the layer forming conditions for a charge injection inhibition layer changed to the figures of Table 15, multiple drums having a light receiving layer and samples having only a charge injection prohibition layer were provided under the same conditions as in Example 2. And they were examined by the same procedures as in Example 2. The results are shown in Table 16.

EXAMPLE 7

With the layer forming conditions for a charge injection inhibition layer changed to the figures of Table 17, multiple drums having a light receiving layer and samples having only a charge injection prohibition layer were provided under the same conditions as in Example 2. And they were examined by the same procedures as in Example 2. The results are shown in Table 18.

EXAMPLE 8

The same procedures of Example 2 were repeated, except that the layer forming conditions for forming a charge injection inhibition layer were changed as shown in Table 19, to thereby prepare multiple drums and samples having only a charge injection inhibition layer.

These drums and samples were examined by the same procedures as in Example 2. The results are shown in Table 20.

EXAMPLE 9

The same procedures of Example 2 were repeated, except that the layer forming conditions for forming a charge injection inhibition layer were changed as shown in Table 21, to thereby prepare multiple drums and samples having only a charge injection inhibition layer.

These drums and samples were examined by the same procedures as in Example 2. The results are shown in Table 22.

EXAMPLE 10

There were prepared multiple light receiving members respectively having a IR layer formed under the different layer forming conditions as shown in Table 23 and a light receiving layer formed under the same layer forming conditions as in Example 2 respectively on the same kind Al cylinder as in Example 2.

They were evaluated by the same procedures as in Example 2.

The results are shown in Table 24.

EXAMPLE 11

Except that the layer forming conditions were changed as shown in Table 25, the drums (No. 1101–1106) were made under the same conditions as Example 10 and were provided the same items as Example 2.

The results are shown in Table 26.

From the resulting drum No. 1102, upper part, middle part and lower part of its image forming part were cut off, and were subjected to the analysis of the element profiles in the thicknesswise direction of germanium atoms in the IR layer by SIMS.

Figure 10:
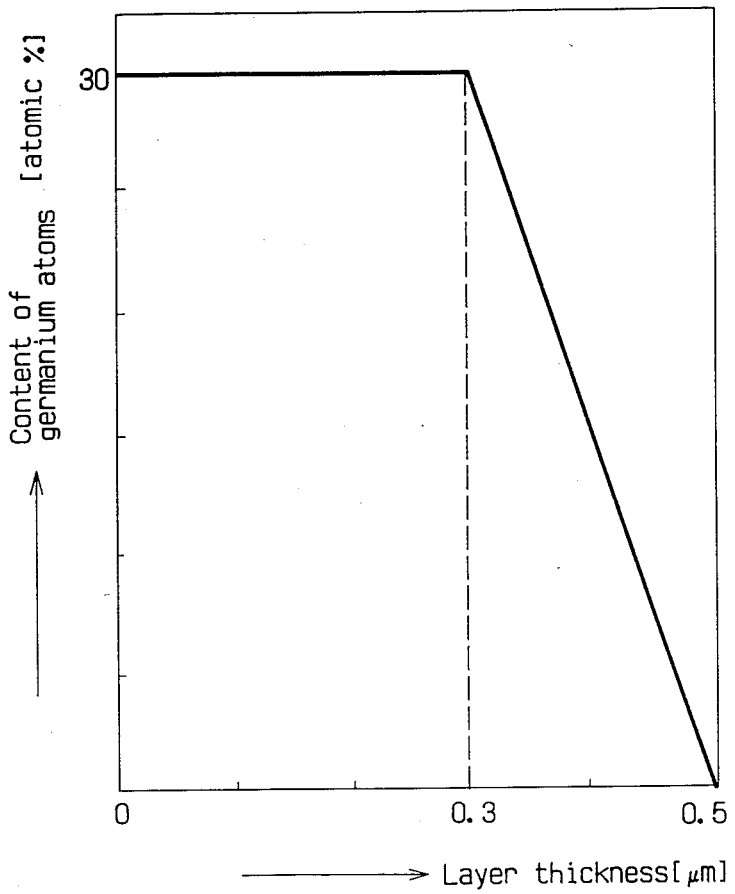
FIG. 10 is a view illustrating the thicknesswise distribution of germanium atoms in the IR layer in Example 10.

The results are shown in FIG. 10.

EXAMPLE 12

There were prepared multiple light receiving members respectively having a contact layer formed under the different layer forming conditions as shown in Table 27 and a light receiving layer formed under the same layer forming conditions as in Example 2 respectively on the same kind Al cylinder as in Example 2.

As for the resulting light receiving members, there were evaluated by the same procedures as in Example 2.

And, some samples having a contact layer on the same kind Al cylinder as in the above case were prepared in the same manners for forming the contact layer in the above case.

As for the resulting samples having only the contact layer, a part of the sample was cut off for each sample, and was subjected to the measurement of diffraction patterns corresponding to Si (111) near 27° of the diffraction angle by the conventional X-ray diffractometer to examine the existence of crystallinity.

The results are shown in Table 28.

EXAMPLE 13

Figure 7:
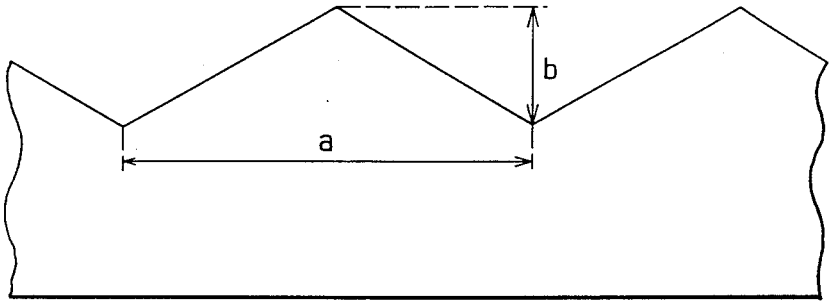
FIG. 7 and FIG. 8 are schematic views respectively illustrating the shape of the surface of the substrate in the light receiving member in Examples 12 and 13.

The mirror grinded cylinders were supplied for grinding process of cutting tool of various degrees. With the patterns of FIG. 7, various cross section patterns as described in Table 29 multiple cylinders were provided These cylinders were set to the fabrication apparatus of FIG. 6 accordingly, and used to produce drums under the same layer forming conditions of Example 2. The resulting drums were evaluated with the conventional electrophotographic copying machine having digital exposure functions and using semiconductor laser of 780 nm wavelength. The results are shown in Table 30.

EXAMPLE 14

Figure 8:
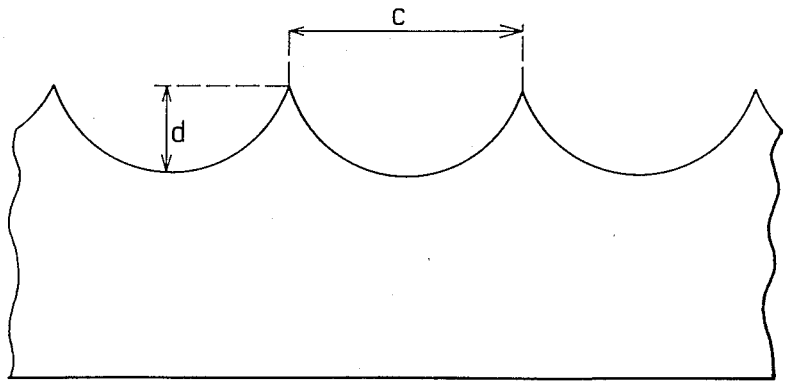

The surface of mirror grinded cylinder was treated by dropping lots of bearing balls thereto to thereby form uneven shape composed of a plurality of fine dimples at the surface, and multiple cylinders having a cross section form of FIG. 8 and of a cross section pattern of Table 31 were provided. These cylinders were set to the fabrication apparatus of FIG. 6 accordingly and used for the preparation of drums under the same layer forming condition of Example 2. The resulting drums are evaluated with the conventional electrophotographic copying machine having digital exposure functions and using semiconductor laser of 780 nm wavelength. The results are shown in Table 32.

TABLE 1

| Name of layer | Gas used and flow rate (SCCM) | | Substrate temperature (°C.) | RF power (W) | Inner pressure (torr) | Layer thickness (μm) |
|---|---|---|---|---|---|---|
| Contact layer | $SiH_4$ | 50 | 250 | 1500 | 0.3 | 0.1 |
| | $H_2$ | 600 | | | | |
| | NO | 600 | | | | |
| Photo-conductive layer | $SiH_4$ | 200 | 250 | 300 | 0.35 | 20 |
| | $B_2H_6$ (against $SiH_4$) | 100 ppm | | | | |
| | NO | 4 | | | | |
| Surface layer | $SiH_4$ | 10 | 250 | 200 | 0.45 | 0.5 |
| | $CH_4$ | 500 | | | | |

TABLE 2

| Initial electrification efficiency | Initial sensitivity | Image flow | Residual voltage | Ghost | Defective image | Deterioration of sensitivity | Increase of defective image | Hydrogen content (atomic %) | Crystallinity |
|---|---|---|---|---|---|---|---|---|---|
| ◎ | ○ | ◎ | ◎ | ◎ | ◎ | ○ | ○ | 30 | Yes |

◎ very good
○ good
Δ practically applicable
x poor

TABLE 3

| Name of layer | Gas used and flow rate (SCCM) | | Substrate temperature (°C.) | RF power (W) | Inner pressure (torr) | Layer thickness (μm) |
|---|---|---|---|---|---|---|
| Contact layer | $SiH_4$ | 50 | 250 | 1500 | 0.3 | 0.1 |
| | $H_2$ | 600 | | | | |
| | NO | 600 | | | | |
| Photo-conductive layer | $SiH_4$ | 200 | 250 | 300 | 0.3 | 20 |
| | $B_2H_6$ (against $SiH_4$) | 100 ppm | | | | |
| | NO | 4 | | | | |
| Surface layer | $SiH_4$ | 10 | 250 | 200 | 0.7 | 0.5 |
| | $CH_4$ | 500 | | | | |
| | $H_2$ | 1000 | | | | |

TABLE 4

| Initial electrification efficiency | Initial sensitivity | Image flow | Residual voltage | Ghost | Defective image | Deterioration of sensitivity | Increase of defective image | Hydrogen content (atomic %) | Crystallinity |
|---|---|---|---|---|---|---|---|---|---|
| x | ○ | ○ | x | Δ | x | ○ | x | 87 | Yes |

◎ Excellent
○ Good
Δ Practically applicable
x Poor

TABLE 5

| Name of layer | Gas used and flow rate (SCCM) | | Substrate temperature (°C.) | RF power (W) | Internal pressure (torr) | Layer thickness (μm) |
|---|---|---|---|---|---|---|
| Contact layer | $SiH_4$ | 50 | 250 | 1500 | 0.3 | 0.1 |
| | $H_2$ | 600 | | | | |
| | NO | 600 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 10 | 250 | 200 | 0.45 | 0.5 |
| | $CH_4$ | 500 | | | | |

TABLE 6

| Initial electrification efficiency | Initial sensitivity | Image flow | Residual voltage | Ghost | Defective image | Deterioration of sensitivity | Increase of defective image | Hydrogen content (atomic %) | Crystallinity |
|---|---|---|---|---|---|---|---|---|---|
| ◎ | ○ | ◎ | ◎ | ◎ | ◎ | ○ | ◎ | 30 | Yes |

◎Excellent
○ good
Δ practically applicable
x poor

TABLE 7

| Name of layer | Gas used and flow rate (SCCM) | | Substrate temperature (°C.) | RF power (W) | Internal pressure (torr) | Layer thickness (μm) |
|---|---|---|---|---|---|---|
| Contact layer | $SiH_4$ | 50 | 250 | 1500 | 0.3 | 0.1 |
| | $H_2$ | 600 | | | | |
| | NO | 600 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 10 | 250 | 200 | 0.7 | 0.5 |
| | $CH_4$ | 500 | | | | |
| | $H_2$ | 1000 | | | | |

TABLE 8

| Initial electrification efficiency | Initial sensitivity | Image flow | Residual voltage | Ghost | Defective image | Deterioration of sensitivity | Increase of defective image | Hydrogen content (atomic %) | Crystallinity |
|---|---|---|---|---|---|---|---|---|---|
| x | ○ | ○ | x | Δ | x | ○ | x | 87 | Yes |

◎Excellent
○ Good
Δ Practically applicable
x Poor

TABLE 9

| Name of layer | Gas used and flow rate (SCCM) | | Substrate temperature (°C.) | RF power (W) | Internal pressure (torr) | Layer thickness (μm) |
|---|---|---|---|---|---|---|
| Contact layer | $SiH_4$ | 50 | 250 | 1500 | 0.1 | 0.1 |
| | $H_2$ | 300 | | | | |
| | NO | 500 | | | | |
| Charge injection inhibition layer | $SiH_4$ | 150 | 250 | 150 | 0.25 | 3 |
| | $B_2H_6$ (against $SiH_4$) | 1000 ppm$^{-0}$ | | | | |
| | NO | $10^{-0}$ | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 10 | 250 | 200 | 0.4 | 0.5 |
| | $CH_4$ | 400 | | | | |

TABLE 10

| Initial electrification efficiency | Initial sensitivity | Image flow | Residual voltage | Ghost | Defective image | Deterioration of sensitivity | Increase of defective image | Hydrogen content (atomic %) | Crystallinity |
|---|---|---|---|---|---|---|---|---|---|
| ◎ | ○ | ◎ | ◎ | ◎ | ◎ | ○ | ◎ | 20 | Yes |

◎ Excellent
○Good
Δ Practically applicable
X Poor

TABLE 11

| Drum No. | 401 | | 402 | | 403 | | 404 | | 405 | | Comparative Example 3 | |
|---|---|---|---|---|---|---|---|---|---|---|---|---|
| Flow rate | $SiH_4$ | 10 | $SiH_4$ | 10 | $SiH_4$ | 20 | $SiH_4$ | 10 | $SiH_4$ | 10 | $SiH_4$ | 10 |

TABLE 11-continued

| Drum No. | 401 | 402 | 403 | 404 | 405 | Comparative Example 3 |
|---|---|---|---|---|---|---|
| (SCCM) | $CH_4$ 600 | $CH_4$ 300 | $CH_4$ 600 | $CH_4$ 400 | $C_2H_4$ 500 | $CH_4$ 500<br>$H_2$ 800 |
| Substrate temperature (°C.) | 250 | 250 | 250 | 250 | 250 | 250 |
| RF power (W) | 200 | 100 | 200 | 180 | 100 | 150 |
| Internal pressure (torr) | 0.5 | 0.38 | 0.5 | 0.39 | 0.45 | 0.65 |
| Layer thickness (μm) | 0.5 | 0.5 | 0.5 | 0.5 | 0.5 | 0.5 |

TABLE 12

| Drum No. | Initial electrification efficiency | Initial sensitivity | Image flow | Residual voltage | Ghost | Defective image | Deterioration of sensitivity | Increase of defective image | Sample No. | Hydrogen content (atomic %) |
|---|---|---|---|---|---|---|---|---|---|---|
| 401 | ◎ | ○ | ○ | ◎ | ○ | ◎ | ○ | ○ | 401-1 | 32 |
| 402 | ◎ | ○ | ◎ | ○ | ○ | ○ | ○ | ○ | 402-1 | 14 |
| 403 | ○ | ○ | ○ | ◎ | ○ | ◎ | ○ | ◎ | 403-1 | 36 |
| 404 | ○ | ○ | ◎ | ○ | ◎ | ○ | ○ | ○ | 404-1 | 19 |
| 405 | ○ | ○ | ◎ | ○ | ◎ | ◎ | ○ | ◎ | 405-1 | 28 |
| Comparative Example 3 | X | ○ | ○ | X | Δ | X | ○ | X | Comparative Example 3-1 | 85 |

◎ Excellent
○ Good
Δ Practically applicable
X Poor

TABLE 13

| Drum No. | 501 | 502 | 503 | 504 | 505 | 506 |
|---|---|---|---|---|---|---|
| Flow rate (SCCM) | $SiH_4$ 350<br>NO 50 | $SiH_4$ 200<br>$H_2$ 600 | $SiH_4$ 350<br>$H_2$ 350<br>$B_2H_6$ 0.3 ppm (against $SiH_4$) | $SiH_4$ 350<br>Ar 350 | $SiH_4$ 350<br>He 350<br>$B_2H_6$ 0.3 ppm (against $SiH_4$) | $SiH_4$ 200<br>$SiF_4$ 100<br>$H_2$ 300 |
| Substrate temperature (°C.) | 250 | 250 | 250 | 250 | 250 | 250 |
| RF power (W) | 200 | 400 | 300 | 250 | 300 | 400 |
| Internal pressure (torr) | 0.4 | 0.42 | 0.4 | 0.4 | 0.4 | 0.38 |
| Layer thickness (μm) | 20 | 20 | 20 | 20 | 20 | 20 |

TABLE 14

| Drum No. | Initial electrification efficiency | Initial sensitivity | Image flow | Residual voltage | Ghost | Defective image | Deterioration of sensitivity | Increase of defective image |
|---|---|---|---|---|---|---|---|---|
| 501 | ○ | ◎ | ◎ | ◎ | ◎ | ◎ | ○ | ◎ |
| 502 | ◎ | ○ | ◎ | ◎ | ◎ | ◎ | ○ | ◎ |
| 503 | ○ | ○ | ◎ | ◎ | ◎ | ◎ | ○ | ○ |
| 504 | ◎ | ○ | ◎ | ◎ | ◎ | ◎ | ○ | ◎ |
| 505 | ○ | ○ | ◎ | ◎ | ◎ | ○ | ○ | ◎ |
| 506 | ◎ | ○ | ◎ | ◎ | ◎ | ◎ | ○ | ○ |

◎ Excellent
○ Good
Δ Practically applicable
X Poor

TABLE 15

| Drum No. | 601 | 602 | 603 | 604 | 605* | 606 |
|---|---|---|---|---|---|---|
| Flow rate (SCCM) | $SiH_4$ 150<br>$B_2H_6$ 500 ppm (against $SiH_4$) | $SiH_4$ 150<br>$B_2H_6$ 100 ppm (against $SiH_4$) | $SiH_4$ 150<br>$PH_3$ 100 ppm (against $SiH_4$) | $SiH_4$ 150<br>$B_2H_6$ 500 ppm (against $SiH_4$) | $SiH_4$ 150<br>$B_2H_6$ 1000 ppm (against $SiH_4$) | $SiH_4$ 100<br>$SiF_4$ 50<br>$B_2H_6$ 500 ppm (against $SiH_4$) |

TABLE 15-continued

| Drum No. | 601 | 602 | 603 | 604 | 605* | 606 |
|---|---|---|---|---|---|---|
| | NO 10<br>$H_2$ 500 | NO 5<br>$H_2$ 700 | NO 5<br>$H_2$ 700 | NO 10<br>Ar 500 | NO 10<br>He 500 | NO 10<br>$H_2$ 500 |
| Substrate temperature (°C.) | 250 | 250 | 250 | 250 | 250 | 250 |
| RF power (W) | 1200 | 1200 | 1200 | 1500 | 1500 | 1500 |
| Internal pressure (torr) | 0.2 | 0.2 | 0.2 | 0.2 | 0.2 | 0.2 |
| Layer thickness (μm) | 1 | 1 | 1 | 1 | 1 | 0.8 |

*Only the conditions for the photoconductive layer are the same as in the case of the drum No. 505

TABLE 16

| Drum No. | Initial electrification efficiency | Initial sensitivity | Image flow | Residual voltage | Ghost | Defective image | Deterioration of sensitivity | Increase of defective image | Remarks |
|---|---|---|---|---|---|---|---|---|---|
| 601 | ◎ | ○ | ◎ | ◎ | ◎ | ○ | ○ | ○ | (−) electrification |
| 602 | ○ | ○ | ◎ | ◎ | ◎ | ◎ | ○ | ○ | |
| 603 | ○ | ○ | ○ | ○ | ◎ | ◎ | ○ | ◎ | |
| 604 | ◎ | ○ | ○ | ◎ | ○ | ◎ | ○ | ◎ | |
| 605 | ○ | ○ | ◎ | ◎ | ◎ | ○ | ○ | ◎ | |
| 606 | ◎ | ○ | ○ | ◎ | ○ | ◎ | ○ | ◎ | |

| Sample No. | Crystallinity |
|---|---|
| 601-1 | Yes |
| 602-1 | Yes |
| 603-1 | Yes |
| 604-1 | Yes |
| 605-1 | Yes |
| 606-1 | Yes |

◎ Excellent
○ Good
Δ Practically applicable
X Poor

TABLE 17

| Drum No. | 701 | 702 | 703 | 704 | 705* | 706 |
|---|---|---|---|---|---|---|
| Flow rate (SCCM) | $SiH_4$ 150<br>$B_2H_6$ 500 ppm → 0 (against $SiH_4$)<br>NO 10 → 0<br>$H_2$ 500 | $SiH_4$ 150<br>$B_2H_6$ 100 ppm → 0 (against $SiH_4$)<br>NO 5 → 0<br>$H_2$ 700 | $SiH_4$ 150<br>$PH_3$ 100 ppm → 0 (against $SiH_4$)<br>NO 5 → 0<br>$H_2$ 700 | $SiH_4$ 150<br>$B_2H_6$ 500 ppm → 0 (against $SiH_4$)<br>NO 10 → 0<br>Ar 500 | $SiH_4$ 150<br>$B_2H_6$ 1000 ppm → 0 (against $SiH_4$)<br>NO 10 → 0<br>He 500 | $SiH_4$ 100<br>$SiF_4$ 50<br>$B_2H_6$ 500 ppm → 0 (against $SiH_4$)<br>NO 10 → 0<br>$H_2$ 500 |
| Substrate temperature (°C.) | 250 | 250 | 250 | 250 | 250 | 250 |
| RF power (W) | 1200 | 1200 | 1200 | 1500 | 1500 | 1500 |
| Internal pressure (torr) | 0.2 | 0.2 | 0.2 | 0.2 | 0.2 | 0.2 |
| Layer thickness (μm) | 1 | 1 | 1 | 1 | 1 | 0.8 |

Only the conditions for the photoconductive layer are the same as in the case of the drum No. 505

TABLE 18

| Drum No. | Initial electrification efficiency | Initial sensitivity | Image flow | Residual voltage | Ghost | Defective image | Deterioration of sensitivity | Increase of defective image |
|---|---|---|---|---|---|---|---|---|
| 701 | ◎ | ○ | ◎ | ◎ | ◎ | ○ | ○ | ◎ |
| 702 | ○ | ○ | ◎ | ◎ | ◎ | ◎ | ○ | ○ |
| 703 | ○ | ○ | ○ | ○ | ○ | ◎ | ○ | ◎ |
| 704 | ◎ | ○ | ○ | ◎ | ◎ | ◎ | ○ | ◎ |
| 705 | ○ | ○ | ◎ | ◎ | ◎ | ◎ | ○ | ◎ |
| 706 | ◎ | ○ | ◎ | ○ | ○ | ◎ | ○ | ◎ |

| Sample No. | Crystallinity |
|---|---|

TABLE 18-continued

| | |
|---|---|
| 701-1 | Yes |
| 702-1 | Yes |
| 703-1 | Yes |
| 704-1 | Yes |
| 705-1 | Yes |
| 706-1 | Yes |

◎Excellent
○ Good
Δ Practically applicable
× Poor

TABLE 19

| Drum No | 801 | 802 | 803 | 804 | 805 | 806 |
|---|---|---|---|---|---|---|
| Flow rate (SCCM) | $SiH_4$ 150<br>$B_2H_6$ 500 ppm (against $SiH_4$)<br>NO 10<br>$H_2$ 350 | $SiH_4$ 150<br>$B_2H_6$ 100 ppm (against $SiH_4$)<br>NO 5<br>$H_2$ 350 | $SiH_4$ 150<br>$PH_3$ 100 ppm (against $SiH_4$)<br>NO 5<br>$H_2$ 350 | $SiH_4$ 150<br>$B_2H_6$ 500 ppm (against $SiH_4$)<br>NO 10<br>Ar 350 | $SiH_4$ 150<br>$B_2H_6$ 1000 ppm (against $SiH_4$)<br>NO 10<br>He 350 | $SiH_4$ 100<br>$SiF_4$ 50<br>$B_2H_6$ 500 ppm (against $SiH_4$)<br>NO 10<br>$H_2$ 350 |
| Substrate temperature (°C.) | 250 | 250 | 250 | 250 | 250 | 250 |
| RF power (W) | 150 | 150 | 150 | 150 | 150 | 150 |
| Internal pressure (torr) | 0.25 | 0.25 | 0.25 | 0.25 | 0.25 | 0.25 |
| Layer thickness (μm) | 3 | 3 | 3 | 3 | 3 | 2.7 |

Remarks
The conditions for the formation of the photoconductive layer are the same as in the case of the drum No. 505

TABLE 20

| Drum No. | Initial electrification efficiency | Initial sensitivity | Image flow | Residual voltage | Ghost | Defective image | Deterioration of sensitivity | Increase of defective image | Remarks |
|---|---|---|---|---|---|---|---|---|---|
| 801 | ◎ | ○ | ◎ | ◎ | ◎ | ○ | ○ | ○ | (-) electrification |
| 802 | ○ | ○ | ○ | ◎ | ◎ | ◎ | ○ | ◎ | |
| 803 | ○ | ○ | ○ | ○ | ◎ | ◎ | ○ | ◎ | |
| 804 | ◎ | ○ | ○ | ◎ | ○ | ◎ | ○ | ◎ | |
| 805 | ○ | ○ | ◎ | ◎ | ◎ | ○ | ○ | ○ | |
| 806 | ◎ | ○ | ○ | ◎ | ○ | ◎ | ○ | ◎ | |

| Sample No. | Crystallinity |
|---|---|
| 801-1 | No |
| 802-1 | No |
| 803-1 | No |
| 804-1 | No |
| 805-1 | No |
| 806-1 | No |

◎Excellent
○ Good
Δ Practically applicable
x poor

TABLE 21

| Drum No. | 901 | 902 | 903 | 904 | 905 | 906 |
|---|---|---|---|---|---|---|
| Flow rate (SCCM) | $SiH_4$ 150<br>$B_2H_6$ 500 ppm → 0 (against $SiH_4$)<br>NO 10 → 0<br>$H_2$ 350 | $SiH_4$ 150<br>$B_2H_6$ 100 ppm → 0 (against $SiH_4$)<br>NO 5 → 0<br>$H_2$ 350 | $SiH_4$ 150<br>$PH_3$ 100 ppm → 0 (against $SiH_4$)<br>NO 5 → 0<br>$H_2$ 350 | $SiH_4$ 150<br>$B_2H_6$ 500 ppm → 0 (against $SiH_4$)<br>NO 10 → 0<br>Ar 350 | $SiH_4$ 150<br>$B_2H_6$ 1000 ppm → 0 (against $SiH_4$)<br>NO 10 → 0<br>He 350 | $SiH_4$ 100<br>$SiF_4$ 50<br>$B_2H_6$ 500 ppm → 0 (against $SiH_4$)<br>NO 10 → 0<br>$H_2$ 350 |
| Substrate temperature (°C.) | 250 | 250 | 250 | 250 | 250 | 250 |
| RF power (W) | 150 | 150 | 150 | 150 | 150 | 150 |
| Internal pressure (torr) | 0.25 | 0.25 | 0.25 | 0.25 | 0.25 | 0.25 |
| Layer thickness | 3 | 3 | 3 | 3 | 3 | 2.7 |

TABLE 21-continued

| Drum No. | 901 | 902 | 903 | 904 | 905 | 906 |
|---|---|---|---|---|---|---|
| (μm) | | | | | | |

Remarks
The conditions for the formation of the photoconductive layer are the same as in the case the drum No. 505

TABLE 22

| Drum No. | Initial electrification efficiency | Initial sensitivity | Image flow | Residual voltage | Ghost | Defective image | Deterioration of sensitivity | Increase of defective image |
|---|---|---|---|---|---|---|---|---|
| 901 | ◎ | ○ | ○ | ◎ | ◎ | ○ | ○ | ○ |
| 902 | ○ | ○ | ○ | ◎ | ◎ | ◎ | ○ | ◎ |
| 903 | ○ | ○ | ○ | ○ | ◎ | ◎ | ○ | ◎ |
| 904 | ◎ | ○ | ○ | ◎ | ○ | ◎ | ○ | ◎ |
| 905 | ○ | ○ | ◎ | ◎ | ◎ | ◎ | ○ | ◎ |
| 906 | ◎ | ○ | ○ | ○ | ○ | ◎ | ○ | ◎ |

| Sample No. | Crystallinity |
|---|---|
| 901-1 | No |
| 902-1 | No |
| 903-1 | No |
| 904-1 | No |
| 905-1 | No |
| 906-1 | No |

◎Excellent
○ Good
Δ Practically applicable
× Poor

TABLE 23

| Drum No. | 1001 | 1002 | 1003 | 1004 | 1005-1 | 1005-2 | 1006 |
|---|---|---|---|---|---|---|---|
| Flow rate (SCCM) | $SiH_4$ 150<br>$B_2H_6$ 1000 ppm (against $SiH_4$)<br>NO 10<br>$GeH_4$ 30<br>$H_2$ 350 | $SiH_4$ 150<br>$B_2H_6$ 500 ppm (against $siH_4$)<br>NO 5<br>$GeH_4$ 50<br>$H_2$ 350 | $SiH_4$ 150<br>$PH_3$ 100 ppm (against $SiH_4$)<br>NO 5<br>$GeH_4$ 70<br>$H_2$ 350 | $SiH_4$ 150<br>$B_2H_6$ 500 ppm (against $SiH_4$)<br>NO 10<br>$GeH_4$ 10<br>Ar 350 | $SiH_4$ 150<br>$B_2H_6$ 1000 ppm (against $SiH_4$)<br>NO 10<br>$GeH_4$ 50<br>He 350 | | $SiH_4$ 100<br>$SiF_4$ 50<br>$B_2H_6$ 1000 ppm (against $SiH_4$)<br>NO 10<br>$GeH_4$ 50<br>$H_2$ 350 |
| Substrate temperature (°C.) | 250 | 250 | 250 | 250 | 250 | | 250 |
| RF power (W) | 150 | 200 | 150 | 150 | 150 | | 150 |
| Internal pressure (torr) | 0.27 | 0.27 | 0.27 | 0.27 | 0.27 | | 0.27 |
| Layer thickness (μm) | 0.5 | 0.5 | 0.5 | 0.5 | 0.5 | | 0.4 |
| Remarks | | | | | * | ** | |

*The conditions for the formation of the photoconductive layer are the same as in the case of the drum No. 505 The conditions for the formation of the charge injection inhibition layer are the same as in the case of the drum No. 805
**The conditions for the formation of the photoconductive layer are the same as in the case of the drum No. 505 The conditions for the formation of the charge injection inhibition layer are the same as in the case of the drum No. 905

TABLE 24

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 1001 | ◎ | ○ | ◎ | ○ | ◎ | ○ | ◎ | ○ | ◎ ○ |
| 1002 | ◎ | ○ | ○ | ○ | ◎ | ◎ | ◎ | ○ | ◎ |
| 1003 | ○ | ○ | ◎ | ○ | ◎ | ◎ | ○ | ○ | ○ |
| 1004 | ◎ | ○ | ○ | ○ | ◎ | ○ | ◎ | ○ | ◎ |
| 1005-1 | ○ | ○ | ◎ | ○ | ◎ | ◎ | ○ | ○ | ○ |
| 1005-2 | ○ | ○ | ◎ | ◎ | ◎ | ◎ | ◎ | ○ | ◎ |
| 1006 | ◎ | ○ | ○ | ○ | ◎ | ◎ | ◎ | ○ | ◎ |

◎ . . Excellent
○ . . . Good
Δ . . . Practically applicable
× . . . Poor

TABLE 25

| Drum No. | 1101 | 1102 | 1103 | 1104 | 1105-1 | 11-5-2 | 1106 |
|---|---|---|---|---|---|---|---|
| Flow rate (SCCM) | $SiH_4$ 150<br>$B_2H_6$ 1000 ppm (against $SiH_4$)<br>NO 10<br>$GeH_4$ 30→0<br>$H_2$ 350 | $SiH_4$ 150<br>$B_2H_6$ 500 ppm (against $SiH_4$)<br>NO 5<br>$GeH_4$ 50→0<br>$H_2$ 350 | $SiH_4$ 150<br>$PH_3$ 100 ppm (against $SiH_4$)<br>NO 5<br>$GeH_4$ 70→0<br>$H_2$ 350 | $SiH_4$ 150<br>$B_2H_6$ 500 ppm (against $SiH_4$)<br>NO 10<br>$GeH_4$ 10→0<br>Ar 350 | $SiH_4$ 150<br>$B_2H_6$ 1000 ppm (against $SiH_4$)<br>NO 10<br>$GeH_4$ 50→0<br>He 350 | $SiH_4$ 100<br>$SiF_4$ 50<br>$B_2H_6$ 1000 ppm (against $SiH_4$)<br>NO 10<br>$GeH_4$ 50→0<br>$H_2$ 350 |
| Substrate temperature (°C.) | 250 | 250 | 250 | 250 | 250 | 250 |
| RF power (W) | 150 | 200 | 150 | 150 | 150 | 150 |
| Internal pressure (torr) | 0.27 | 0.27 | 0.27 | 0.27 | 0.27 | 0.27 |
| Layer thickness (μm) | 0.5 | 0.5 | 0.5 | 0.5 | 0.5 | 0.4 |
| Remarks | | | | | * | ** |

*The conditions for the formation of the photoconductive layer are the same as in the case of the drum No. 505 The conditions for the formation of the charge injection inhibition layer are the same as in the case of the drum No. 805

**The conditions for the formation of the photoconductive layer are the same as in the case of the drum No. 505 The conditions for the formation of the charge injection inhibition layer are the same as in the case of the drum No. 905.

TABLE 26

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 1101 | ◎ | ○ | ◎ | ◎ | ◎ | ○ | ◎ | ○ | ◎ |
| 1102 | ◎ | ○ | ○ | ◎ | ◎ | ◎ | ◎ | ○ | ◎ |
| 1103 | ○ | ○ | ◎ | ◎ | ◎ | ◎ | ○ | ○ | ○ |
| 1104 | ◎ | ○ | ○ | ○ | ◎ | ○ | ◎ | ○ | ◎ |
| 1105-1 | ○ | ○ | ◎ | ◎ | ◎ | ◎ | ◎ | ○ | ◎ |
| 1105-2 | ○ | ○ | ◎ | ◎ | ◎ | ◎ | ◎ | ○ | ◎ |
| 1106 | ◎ | ○ | ○ | ◎ | ◎ | ◎ | ◎ | ○ | ◎ |

◎. . . Excellent
○ . . . Good
Δ . . . Practically applicable
x . . . Poor

TABLE 27

| Drum No. | 1201 | 1202 | 1203 | 1204 | 1205-1 2 3 4 | 1206 |
|---|---|---|---|---|---|---|
| Flow rate (SCCM) | $SiH_4$ 50<br>$H_2$ 600<br>$NH_3$ 500 | $SiH_4$ 50<br>$H_2$ 600<br>NO 500<br>$B_2H_6$ 1000 ppm (Against $SiH_4$) | $SiH_4$ 50<br>$H_2$ 600<br>$N_2$ 500 | $SiH_4$ 50<br>$H_2$ 600<br>NO 600<br>$PH_3$ 100 ppm (Against $SiH_4$) | $SiH_4$ 50<br>He 600<br>NO 500 | $SiH_4$ 50<br>$H_2$ 600<br>$N_2$ 300 |
| Substrate temperature (°C.) | 350 | 350 | 350 | 250 | 250 | 250 |
| RF power (W) | 1200 | 1200 | 1200 | 1500 | 1500 | 1500 |
| Internal pressure (torr) | 0.25 | 0.25 | 0.25 | 0.25 | 0.25 | 0.1 |
| Layer thickness (μm) | 0.1 | 0.1 | 0.1 | 0.1 | 0.1 | 0.1 |
| Remarks | | | | | (1) (2) (3) (4) | |

(1) (2) (3) (4): The conditions for the formation of the IR layer in the cases (1) (2) (3) and (4) are the same as in the case of the drum No. 1005-1, 1005-2 1105-1, 1105-2 respectively.

TABLE 28

| Drum No. | Initial electrification efficiency | Initial sensitivity | Image flow | Interference fringe | Residual voltage | Ghost | Defective image | Deterioration of sensitivity | Increase of defective image | Sample No. | Crystallinity |
|---|---|---|---|---|---|---|---|---|---|---|---|
| 1201 | ◎ | ○ | ◎ | ○ | ◎ | ◎ | ◎ | ○ | ◎ | 1201-1 | Yes |
| 1202 | ◎ | ○ | ○ | ○ | ◎ | ◎ | ◎ | ○ | ◎ | 1202-1 | Yes |
| 1203 | ◎ | ○ | ◎ | ○ | ◎ | ◎ | ◎ | ○ | ◎ | 1203-1 | Yes |
| 1204 | ◎ | ○ | ○ | ○ | ○ | ○ | ◎ | ○ | ○ | 1204-1 | Yes |
| 1205-1 | ○ | ○ | ◎ | ○ | ◎ | ◎ | ○ | ○ | ○ | 1205-5 | Yes |
| 1205-2 | ○ | ○ | ◎ | ◎ | ◎ | ◎ | ◎ | ○ | ◎ | 1205-6 | Yes |
| 1205-3 | ○ | ○ | ◎ | ◎ | ◎ | ◎ | ◎ | ○ | ◎ | 1205-7 | Yes |
| 1205-4 | ○ | ○ | ◎ | ◎ | ◎ | ◎ | ◎ | ○ | ◎ | 1205-8 | Yes |

TABLE 28-continued

| Drum No. | Initial electrification efficiency | Initial sensitivity | Image flow | Interference fringe | Residual voltage | Ghost | Defective image | Deterioration of sensitivity | Increase of defective image | Sample No. | Crystallinity |
|---|---|---|---|---|---|---|---|---|---|---|---|
| 1206 | ◎ | ○ | ◎ | ○ | ○ | ○ | ○ | ○ | ◎ | 1206-1 | Yes |

◎ . . . Excellent
○ . . . Good
Δ . . . Practically applicable
x . . . Poor

TABLE 29

| Drum No. | 1301 | 1302 | 1303 | 1304 | 1305 |
|---|---|---|---|---|---|
| a [μm] | 25 | 50 | 50 | 12 | 12 |
| b [μm] | 0.8 | 2.5 | 0.8 | 1.5 | 0.3 |

TABLE 30

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 1301 | ◎ | ○ | ◎ | Δ | ◎ | ◎ | ◎ | ○ | ◎ | ○ |
| 1302 | ◎ | ○ | ◎ | ○ | ◎ | ◎ | ◎ | ○ | ◎ | Δ |
| 1303 | ◎ | ○ | ◎ | Δ | ◎ | ◎ | ◎ | ○ | ◎ | Δ |
| 1304 | ◎ | ○ | ◎ | ○ | ◎ | ◎ | ◎ | ○ | ◎ | ○ |
| 1305 | ◎ | ○ | ◎ | Δ | ◎ | ◎ | ◎ | ○ | ◎ | Δ |

◎ . . Excellent
○ . . . Good
Δ . . . Practically applicable
x . . . Poor

TABLE 31

| Drum No. | 1401 | 1402 | 1403 | 1404 | 1405 |
|---|---|---|---|---|---|
| c [μm] | 50 | 100 | 100 | 30 | 30 |
| d [μm] | 2 | 5 | 1.5 | 2.5 | 0.7 |

TABLE 32

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 1401 | ◎ | ○ | ◎ | Δ-○ | ◎ | ◎ | ◎ | ○ | ◎ | Δ |
| 1402 | ◎ | ○ | ◎ | ○ | ◎ | ◎ | ◎ | ○ | ◎ | Δ |
| 1403 | ◎ | ○ | ◎ | Δ | ◎ | ◎ | ◎ | ○ | ◎ | Δ |
| 1404 | ◎ | ○ | ◎ | ○ | ◎ | ◎ | ◎ | ○ | ◎ | ○ |
| 1405 | ◎ | ○ | ◎ | Δ-○ | ◎ | ◎ | ◎ | ○ | ◎ | Δ- |

◎ . . Excellent
○ . . . Good
x . . . Practically applicable
Δ . . . Poor

What we claim is:

1. A light receiving member for use in electrophotography comprising (a) a substrate for electrophtography and (b) a light receiving layer; said light receiving layer comprising (i) a contact layer from 0.02 to 10 μm in thickness, (ii) a phtoconductive layer from 1 to 100 μm in thickness and (iii) a surface layer from 0.003 to 30 μm in thickness in this order from the side of said substrate; said contact layer (i) comprising a polycrystalline material containing silicon atoms as the main constituent and at least one kind selected from the group consisting of nitorgen atoms, oxygen atoms and carbon atoms in a total amount of 0.0005 to 70 atomic %; said photoconductive layer (ii) comprising an amorphous semiconductor material containing silicon atoms as the main constituent and at least one kind selected from the group consisting of hydrogen atoms and halogen atoms; and said surface layer (iii) comprising an amorphous material containing silicon atoms as the main constituent, carbon atoms in an amount of 0.001 to 90 atomic % and hydrogen atoms in an amount of 0.001 to 40 atomic %.

2. A light receiving member for use in electrophotography according to claim 1, wherein the substrate is electrically insulative.

3. A light receiving member for use in electrophotography according to claim 1, wherein the substraste is electroconductive.

4. A light receiving member for use in electrophotography according to claim 1, wherein the substrate is an aluminum alloy.

5. A light receiving member for use in electrophotography according to claim 1, wherein the substrate is cylindrical in form.

6. A light receiving member for use in electrophotography according to claim 1, wherein the substrate has an uneven surface.

7. A light receiving member for use in electrophotography according to claim 1, wherein the substrate has an irregular surface.

8. A light receiving member for use in electrophtography according to claim 1, wherein the contact layer further contains at least one kind selected from hydrogen atoms and halogen atoms in a total amount of 0.1 to 70 atomic %.

9. A light receiving member for use in electrophtography according to claim 1, wherein the photoconductive layer has p-type semiconductor characteristics.

10. A light receiving member for use in electrophtography according to claim 1, wherein the photoconductive layer has n-type semiconductor characteristics.

11. A light receiving member for use in electrophotography according to claim 1, wherein the photoconductive layer has i-type semiconductor characteristics.

12. A light receiving member for use in electrophotography according to claim 1, wherein the photoconductive layer contains an element of Group III of the Periodic Table.

13. A light receiving member for use in electrophotography according to claim 12, wherein said element is selected from the group consisting of B, Al, Ga, In or T1.

14. A light receiving member for use in electrophotography according to claim 12, wherein the amount of said element contained in the photoconductive layer is in the range of 0.001 to 300 atomic ppm.

15. A light receiving member for use in electrophotography according to claim 1, wherein the photoconductive layer contains an element of Group V of the Periodic Table.

16. A light receiving member for use in electrophotography according to claim 15, wherein said element is selected from the group consisting of P, As, Sb or Bi.

17. A light receiving member for use in electrophotography according to claim 15, wherein the amount of said element contained in the photoconductive layer is in the range of 0.001 to 300 atomic ppm.

18. A light receiving member for use in electrophotography according to claim 1, wherein the photoconductive layer contains 1 to 40 atomic % of said hydrogen atoms.

19. A light receiving member for use in electrophtography according to claim 1, wherein the photoconductive layer contains 1 to 40 atomic % of said halogen atoms.

20. A light receiving member for use in electrophtography according to claim 1, wherein the photoconductive layer contains the hydrogen atoms and the halogen atoms in a total amount of 1 to 40 atomic %.

21. A light receiving member for use in electrophtography according to claim 1, wherein the photoconductive layer contains a least one kind selected from the group consisting of nitrogen atoms and oxygen atoms.

22. A light receiving member for use in electrophotography according to claim 21, wherein the amount of the nitrogen atoms contained in the photoconductive layer is in the range of $5\times10^{-4}$ to 30 atomic %.

23. A light receiving member for use in electrophotography according to claim 21, wherein the amount of the oxygen atoms contained in the photoconductive layer is in the range of $5\times10^{-4}$ to 30 atomic %.

24. A light receiving member for use in electrophotographyy acocrding to claim 21, wherein the sum of the nitrogen atoms and of the oxygen atoms in the photoconductive layer is in the range of $5\times10^{-4}$ to 30 atomic %.

25. A light receving member for use in electrophotography according to claim 1, wherein the light receiving layer further contains a charge injection inhibition layer from 0.01 to 10 μm in thickness on the contact layer.

26. A light receiving member for use in electrophotography according to claim 25, wherein the charge injection inhibition layer comprises an amorphous material containing silicon atoms as the main constituent, a conuctivity controlling element and at least one kind selected from the group consisting of hydrogen atoms and halogen atoms.

27. A light receiving member for use in electrophotography according to claim 26, wherein said amorphous material further contains at least one kind selected from the group consisting of nitrogen atoms, oxygen atoms and carbon atoms.

28. A light receiving member for use in electrophotography according to claim 25, wherein the charge injection inhibition layer comprises a polycrystalline material containing silicon atoms as the main constituent, a conductivity controlling element and at least one kind selected from the group consisting of hydrogen atoms and halogen atoms.

29. A light receiving member for use in electrophotography according to claim 28, wherein said polycrystalline material further contains at least one kind selected from the group consisting of nitrogen atoms, oxygen atoms and carbon atoms.

30. A light receiving member for use in electrophotography according to claim 25, wherein a long wavelength light absorption layer 30 Å to 50 μm in thickness is disposed between the contact layer and the charge injection inhibition layer.

31. A light receiving member for use in electrophotography according to claim 30, wherein the long wavelength light absorption layer comprises a silicon-containing amorphous material containing germanium atoms in an amount of 1 to $1\times10^{6}$ atomic ppm based on the total amount of the silicon atoms and the germanium atoms, and at least one kind selected from the group consisting of hydrogen atoms and halogen atoms.

32. A light receiving member for use in electrophotography according to claim 31, wherein said silicon-containing amorphous material additionally contains a conductivity controlling element.

33. A light receiving member for use in electrophotography according to claim 32, wherein the silicon-containing amorphous material further contains at least one kind selected from the group consisting of nitrogen atoms, oxygen atoms and carbon atoms.

34. An electrophotographic process comprising:

(a) applying a charge to the light receiving member of claim 1; and (b) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

On the title page:

IN [56] REFERENCE CITED

U.S. PATENT DOCUMENTS, "Shimtzu et al." should read --Shimizu et al.-- and "4,666,808 5/1977 Kawamura et al." should read --4,666,808 5/1987 Kawamura et al.--.

IN [75] INVENTORS

"Shigeru Shirai, Shiga;" should read --Shigeru Shirai, Nagahama;-- and "Takayoshi Arai, Nagahami;" should read --Takayoshi Arai, Nagahama;--.

COLUMN 2

Line 15, "much" should read --very--.
Line 66, "Other" should read --Another--.

COLUMN 3

Line 37, "is ranging" should read --ranges--.
Line 52, " "A-SiGe(H,Z)"]," should read --A-SiGe(H,X)"],--.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 4

Line 7, "phtoconductive" should read --photoconductive--.
Line 16, "along" should read --a long--.
Line 17, "registant" should read --resistance--.
Line 18, "cause" should read --causes--.

COLUMN 6

Line 10, "bite" should read --bit--.
Line 44, "on" should read --to--.
Line 51, "dimention" should read --dimensions--.

COLUMN 7

Line 15, "In alternative," should read --Alternatively,--.
Line 61, "graviationally" should read --gravitationally--.
Line 67, "fur" should read --for--.

COLUMN 9

Line 31, "accepted" should read --acceptor--.
Line 55, "or the periodical" should read --of the periodic--.
Line 58, "periodical" should read --periodic--.
Line 63, "phor)," should read --phorus),--.
Line 67, "th" should read --the--.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 10

Line 24, "1X10 to" should read --$1X10^{-2}$ to--.
Line 34, "and" should read --are--.

COLUMN 11

Line 13, "in" should read --no--.
Line 59, "that is" should read --it is--.

COLUMN 12

Line 44, "halongen" should read --halogen--.

COLUMN 13

Line 1, "thicknesscs" should read --thicknesses--.
Line 22, "te" should read --the--.
Line 33, "requirements. preferably 5X10 to X $10^4$" should read --requirements. However, it is preferably 3X10 to $5X10^4$ atomic ppm, more preferably 5X10 to $1X10^4$--.

COLUMN 14

Line 5, "is" should read --are--.
Line 53, "is" should read --are--.
Line 54, "inhibitation" should read --inhibition--.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 15

Line 8, "prferably" should read --preferably--.
Line 48, "gases" should read --gaseous--.

COLUMN 16

Line 68, "composed" should be deleted.

COLUMN 17

Line 33, "atom" should read --atoms--.

COLUMN 19

Line 6, "(F3N)" should read --($F_3N$)--.
Line 66, "gases" should read --gaseous--.

COLUMN 20

Line 20, "to" should be deleted.

COLUMN 21

Line 28, "flow" should read --glow--.
Line 38, "on" should read --an--.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 23

Line 37, "2403," should read --603,--.
Line 54, "2404," should read --604,--.
Line 68, "637" should read --substrate 637--.

COLUMN 24

Line 1, "heater 648" should read --heater 638--.
Line 6, "2437." should read --637.--.
Line 17, "atoms in" should read --atoms is--.
Line 18, "in stead of" should read --instead by--.
Line 29, "holds" should read --folds--.
Line 30, "rised." should read --raised.--.
Line 39, "ambunt" should read --amount--.
Line 50, "upon" should be deleted.
Line 67, "king" should read --kind of--.

COLUMN 25

Line 10, "on" should read --of--.
Line 18, "analize" should read --analyze--.
Line 42, "much" should read --many--.
Line 62, "on" should read --of--.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 26

Line 4, "analize" should read --analyze--.
Line 14, "evaluation," should read --evaluations,--.
Line 28, "much" should read --many--.
Line 49, "on" should read --of--.
Line 53, "or" should read --on--.
Line 59, "analize" should read --analyze--.

COLUMN 28

Line 56, "provided" should read --provided.--.

COLUMN 30

Line 1, "are" should read --were--.

COLUMN 33

Table 12, " Ghost should read -- Ghost

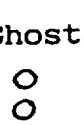

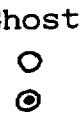

" --.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 34

Table 12, " Increase of defective image ○ Sample No. 401-1 "

should read

-- Increase of defective image ◎ Sample No. 401-1 --.

COLUMN 35

Table 18, "706 ◎ ○ ◎ " should read --706 ◎ ○ ○ --.

and

" Ghost ◎ ◎ ○ ◎ " should read -- Ghost ◎ ◎ ◎ ○ --.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 36

Table 16, " Increase of defective image

| | Remarks |
|---|---|
| ○ | |
| ○ | (-) electrifi-cation |
| ◎ | |

should read

-- Increase of defective image

| | Remarks |
|---|---|
| ○ | |
| ○ | |
| ◎ | (-) electrifi-cation |

--

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMNS 37-38

Table 19, "The conditions ... No. 505" should be placed under Drum No. 805, not the Table as a whole.

COLUMN 38

Table 20, "

| Increase of defective image | Remarks |
|---|---|
| ○ | (-) electrifi- cation " |
| ⊙ | |
| ◎ | |

should read

--

| Increase of defective image | Remarks |
|---|---|
| ○ | |
| ⊙ | |
| ◎ | (-) electrifi- cation --. |

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL. Page 10 of 12

It is certified that error appears in the above-identified patent and that said Letters Patent is hereby corrected as shown below:

COLUMNS 39-40

Table 21-continued, "The conditions ... No. 505" should be placed under Drum No. 905, not the Table as a whole.

COLUMN 39

Table 22, "Image flow ○ " should read --Image flow ◎ --.

COLUMN 40

Table 24, " Increase of defective image ◎ ○ " should read -- Increase of defective image ◎ --.

COLUMN 42

Table 25, "1105-1 11-5-2" should read --1105-1 1105-2--.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 43

Line 52, "electrophtography" should read --electrophotography--.

Line 55, "phtoconductive" should read --photoconductive--.

Line 61, "nitorgen" should read --nitrogen--.

COLUMN 44

Table 32, " Image resolv- ing power

Δ
Δ
Δ
○
Δ-

" should read -- Image resolv- ing power

Δ
Δ
Δ
○
Δ-○

--.

Line 31, "substraste" should read --substrate--.

Line 61, "electrophtog-" should read --electrophotog- --.

Line 66, "electrophtog-" should read --electrophotog- --.

UNITED STATES PATENT AND TRADEMARK OFFICE

CERTIFICATE OF CORRECTION

PATENT NO. : 4,780,387

DATED : October 25, 1988

INVENTOR(S) : SHIGERU SHIRAI, ET AL.

It is certified that error appears in the above-identified patent and that said Letters Patent is hereby corrected as shown below:

COLUMN 45

Line 1, "electrophtog-" should read --electrophotog- --.
Line 34, "electrophtog-" should read --electorphotog- --.
Line 38, "electrophtog-" should read --electrophotog- --.
Line 42, "electrophtog-" should read --electorphotog- --.
Line 55, "graphyy acocrding" should read --graphy according--.

COLUMN 46

Line 1, "receving" should read --receiving--.
Line 10, "conuctivity" should read --conductivity--.

Signed and Sealed this

First Day of January, 1991

*Attest:*

HARRY F. MANBECK, JR.

*Attesting Officer*

*Commissioner of Patents and Trademarks*

--